US009075381B2

(12) United States Patent
Hiraguchi et al.

(10) Patent No.: US 9,075,381 B2
(45) Date of Patent: Jul. 7, 2015

(54) IMAGE FORMING DEVICE AND CHARGING METHOD FOR SECONDARY BATTERY

(71) Applicant: Konica Minolta, Inc., Chiyoda-ku (JP)

(72) Inventors: Hiroshi Hiraguchi, Toyokawa (JP); Takashi Hasebe, Sagamihara (JP); Tomonobu Tamura, Toyokawa (JP); Yasutaka Tanimura, Nara (JP); Yuhei Tatsumoto, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/089,997

(22) Filed: Nov. 26, 2013

(65) Prior Publication Data

US 2014/0147157 A1 May 29, 2014

(30) Foreign Application Priority Data

Nov. 29, 2012 (JP) ..... 2012-260909

(51) Int. Cl.
*G03G 15/00* (2006.01)
*G03G 21/00* (2006.01)

(52) U.S. Cl.
CPC ..... *G03G 15/80* (2013.01)

(58) Field of Classification Search
CPC ..... G03G 15/80; G03G 15/5004
USPC ..... 399/88, 69, 37, 82
See application file for complete search history.

(56) References Cited

U.S. PATENT DOCUMENTS 5,818,203 A 10/1998 Narita
6,124,700 A 9/2000 Nagai et al.
2005/0139591 A1* 6/2005 Takamatsu et al. ..... 219/663
2012/0093537 A1* 4/2012 Eguchi et al. ..... 399/88
2013/0169612 A1* 7/2013 Woo et al. ..... 345/211
2013/0188979 A1* 7/2013 Okada ..... 399/88
2013/0214606 A1* 8/2013 Hasebe et al. ..... 307/80

FOREIGN PATENT DOCUMENTS

JP 07-199739 A 8/1995
JP 9-200971 A 7/1997
JP 10-191577 A 7/1998

(Continued)

OTHER PUBLICATIONS

Office Action (Notification of Reasons for Refusal) issued on Oct. 14, 2014, by the Japanese Patent Office in corresponding Japanese Patent Application No. 2012-260909, and an English Translation of the Office Action. (5 pages).

*Primary Examiner* — Sophia S Chen
(74) *Attorney, Agent, or Firm* — Buchanan Ingersoll & Rooney PC

(57) ABSTRACT

The image forming device includes a reception unit, an image forming unit, a switching unit, a detection unit, and a charging unit. The switching unit switches the image forming device between a first mode in which the reception unit is not supplied a voltage from a power source, is supplied power from a secondary battery, and receives image forming requests, and a second mode in which the image forming unit is supplied the voltage and performs image forming. The detection unit detects a value of an amount of energy of the secondary battery. In the second mode, the charging unit charges the secondary battery by supplying the voltage to the secondary battery when the value is equal to or less than a threshold value, and the charging unit boosts the voltage and supplies the boosted voltage to the secondary battery when the value is greater than the threshold value.

19 Claims, 15 Drawing Sheets

(56) References Cited

FOREIGN PATENT DOCUMENTS

| | | | |
|---|---|---|---|
| JP | 2007-109081 A | | 4/2007 |
| JP | 2007-336664 A | * | 12/2007 |
| JP | 2008-187845 A | | 8/2008 |
| JP | 2012-088485 A | | 5/2012 |

* cited by examiner

<First control (amount of energy 0-80%)>

<Second control (amount of energy 80-100%)>

<Comparative example (amount of energy 0-100%)>

FIG. 7

| Mode | | Charging method | |
|---|---|---|---|
| | | Amount of energy (0-80%) | Amount of energy (80-100%) |
| Operation mode | | First control | Second control |
| Low power mode | | —— | —— |
| Sleep mode | | —— | —— |
| Supplemental charging mode | Monday-Thursday | First control | —— |
| | Friday | First control | Second control |
| Urgent charging mode | | First control | —— |

IMAGE FORMING DEVICE AND CHARGING METHOD FOR SECONDARY BATTERY

This application is based on an application No. 2012-260909 filed in Japan, the contents of which are hereby incorporated by reference.

BACKGROUND OF THE INVENTION (1) Field of the Invention

The present invention relates to image forming devices such as printers, and to charging methods for secondary batteries.

(2) Description of the Related Art

An image forming device, such as a printer, is provided with an image forming unit that executes an image forming job of forming an image on a recording sheet, and a reception unit such as an interface that receives an execution request for the image forming job. With respect to such an image forming device, a proposal is being made of a configuration for realizing a system using both power from a secondary battery such as a nickel-hydrogen battery and power from an external power source such as a commercial power supply. An image forming device with such a configuration switches between a sleep mode and an operation mode.

The sleep mode is a mode of the image forming device in which, when the image forming unit is not executing an image forming job, the reception unit is not supplied power from the external power source, is supplied power from the secondary battery, and is able to receive an execution request for an image forming job. The operation mode is a mode of the image forming device in which, when an execution request for an image forming job is received, the image forming unit executes the image forming job by using power from the external power source.

By making such a configuration where an image forming job is executed when the image forming device is in the operation mode and the image forming device switches to the sleep mode when an image forming job is not being executed, energy can be conserved since power from the commercial power supply is not used when the image forming device is in the sleep mode. Furthermore, by making such a configuration, power from the secondary battery is supplied to the reception unit when the image forming device is in the sleep mode, and thus, an execution request for an image forming job can be received when the image forming device is in the sleep mode.

When adopting the above-described configuration of switching between different modes, it suffices that charging of the secondary battery is performed when the image forming device is in the operation mode, and discharging of the charged secondary battery is performed when the image forming device is in the sleep mode.

In addition, such an image forming device is typically provided with a power supply unit that converts a voltage from the external power source into a voltage suitable for the operation of the image forming unit and outputs the voltage. Further, for charging the secondary battery, a circuit configuration is often adopted including a booster circuit that boosts the voltage outputted by the power supply unit to the voltage necessary to fully charge the secondary battery, and supplies the boosted voltage to the secondary battery. By adopting such a circuit configuration, the secondary battery can be fully charged while utilizing a conventional power supply unit.

When the circuit configuration described above, which uses the booster circuit, is adopted, a considerable power loss occurs when the voltage is changed, or in other words boosted, to the boosted voltage. Therefore, the state of power loss continues from when charging of the secondary battery is started until when the secondary battery is fully charged. As such, the efficiency of charging of the secondary battery is decreased.

Such a technical problem is not only limited to occurring when adopting the configuration of switching between the sleep mode and the operation mode, but can occur in any configuration where a reception unit, such as an interface, is driven by being supplied with power from a secondary battery

SUMMARY OF THE INVENTION

An aim of the present invention is to provide an image forming device and a charging method of a secondary battery, both of which improve the efficiency of charging of the secondary battery.

To achieve the above aim, the image forming device pertaining to the present invention comprises: a reception unit that receives a request for image forming; an image forming unit that performs image forming upon reception of the request by the reception unit and based on the request; a switching unit configured to switch a mode of the image forming device, the mode including a first mode in which the reception unit is not supplied an output voltage from a power source, is supplied power from a secondary battery, and is able to receive the request, and a second mode in which the image forming unit is supplied the output voltage from the power source and performs the image forming; a detection unit configured to detect a value of an amount of energy in the secondary battery; and a charging unit having a voltage booster and being configured to charge the secondary battery by performing a first control of supplying the output voltage from the power source to the secondary battery, and a second control of boosting the output voltage from the power source through the voltage booster and supplying the boosted voltage to the secondary battery, the charging unit, when the mode is the second mode, performing the first control when the value is equal to or less than a predetermined threshold value, and performing the second control when the value is greater than the predetermined threshold value.

The above aim is also achieved by the charging method pertaining to the present invention, which is for a secondary battery that is installed in an image forming device that includes a reception unit that receives a request for image forming and an image forming unit that performs image forming upon reception of the request by the reception unit and based on the request, the charging method comprising: switching a mode of the image forming device, the mode including a first mode in which the reception unit is not supplied an output voltage from a power source, is supplied power from a secondary battery, and is able to receive the request, and a second mode in which the image forming unit is supplied the output voltage from the power source and performs the image forming; detecting a value of an amount of energy in the secondary battery; and charging the secondary battery by performing a first control of supplying the output voltage from the power source to the secondary battery, and a second control of boosting the output voltage from the power source through a voltage booster and supplying the boosted voltage to the secondary battery, and when the mode is the second mode, performing the first control when the value is equal to or less than a predetermined threshold value, and performing the second control when the value is greater than the predetermined threshold value.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 7 is a diagram illustrating the correspondence between modes and charging methods;

DESCRIPTION OF THE PREFERRED EMBODIMENTS

The following describes an embodiment of an image forming device and a charging method of a secondary battery pertaining to the present invention, with reference to the drawings.

(1) Overall Configuration of Image Forming Device

Figure 1:
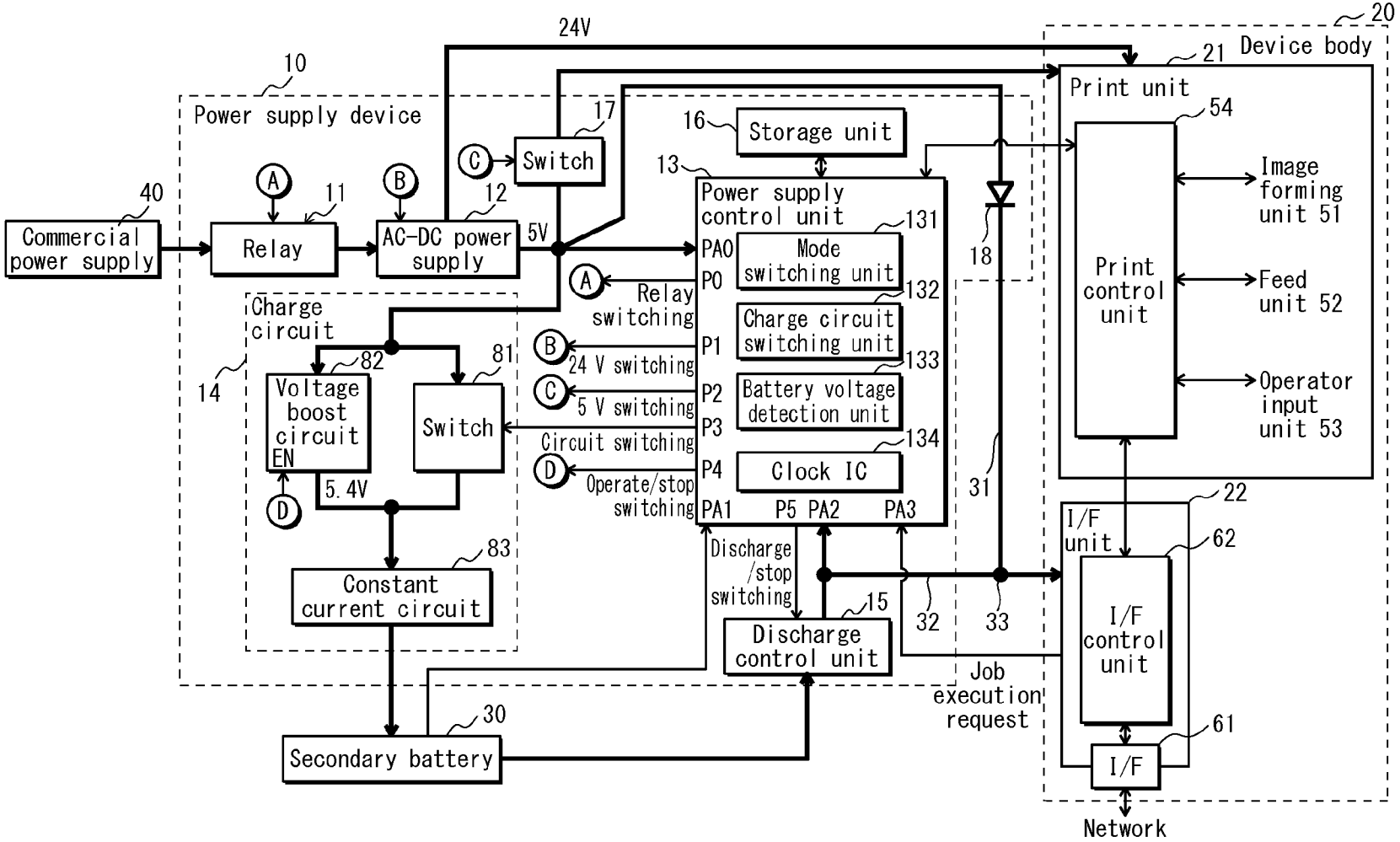
FIG. 1 is a block diagram for explaining the configuration of an image forming device.

FIG. 1 is a block diagram for explaining the configuration of the image forming device.

As shown in FIG. 1, the image forming device is a multiple function peripheral (MFP) capable of executing image forming jobs including printing and facsimile communication. The image forming device includes a power supply device 10 and a device body 20. In FIG. 1, arrows illustrated by using thick solid lines illustrate power lines, and arrows illustrated by using thin solid lines primarily illustrate communication lines for data, signals, etc.

(2) Configuration of Device Body 20

The device body 20 includes a print unit 21 and an interface (I/F) unit 22.

The print unit 21 includes an image forming unit 51, a feed unit 52, an operator input unit 53, and a print control unit 54. The print unit 21 operates by using a voltage output from the power supply device 10 as a drive source.

The image forming unit 51 forms an image on a recording sheet based on image data, according to the electrophotographic method. Note that the image forming unit 51 is not limited to performing image forming according to the electrophotographic method, and may, for example, perform image forming according to the inkjet method.

The feed unit 52 feeds a recording sheet to the image forming unit 51.

The operator input unit 53 receives input of a variety of information from a user. The variety of information includes a sleep mode time setting that is described later. By using the operator input unit 53, a user is able to set the sleep mode time setting for each day in advance. The sleep mode time setting includes a start time and an end time of the sleep mode, and for example, the sleep mode for a given day may be from 6 p.m. on the given day until 9 a.m. the following day, or that is, the night time of the given day. Further, the user is able to set, as the sleep mode time setting, not only a specific time period within a given day, but the entire day of a "non-working day", as defined in the present disclosure, which for example, may be a Sunday.

The print control unit 54 controls the image forming unit 51 and the feed unit 52 to execute an image forming job based on image data.

The I/F unit 22 includes an interface (I/F) 61 and an I/F control unit 62. The I/F unit 22 operates by using, as a drive source, the output voltage of the power supply device 10 or a voltage output from the secondary battery 30.

The I/F 61 is connected to a network such as a LAN and receives, via the network, data of an image forming job (job data) from an external terminal device such as a personal computer or a facsimile device. The job data includes image data and execution conditions such as the number of copies to be printed.

The I/F 61 may be wireless or wired, but it is desirable that the I/F 61 use a system that has low power consumption. Examples of wireless technology having low power consumption include infrared data communication, visible light communication, human body communication, ZigBee, Z-Wave, and Bluetooth™ Low. When the I/F 61 receives the job data as an execution request for an image forming job, the I/F 61 transmits the job data to the I/F control unit 62.

The I/F control unit 62, upon receiving the job data for the image forming job from the I/F 61, notifies the print control unit 54 of the execution request for the image forming job, and transmits the job data to the print control unit 54. The print control unit 54, upon receiving the image data and execution conditions such as the number of copies to be printed, which are included in the job data, executes the image forming job in accordance with the execution conditions.

Further, the I/F control unit 62, regardless of whether voltage is being supplied from the power supply device 10 or the secondary battery 30 as the drive source, converts the voltage being supplied thereto as the drive source to a voltage suitable as a drive source for the I/F 61, and supplies the converted voltage to the I/F 61.

(3) Configuration of Power Supply Device 10

The power supply device 10 performs such controls as a control of supplying external power to the device body 20, and a control of charging and discharging the secondary battery 30. Here, the "external power" refers to AC power being supplied to the power supply device 10 from an external power source, in this case a commercial power supply 40. The power supply device 10 includes a relay 11, an AC-DC power supply 12, a power supply control unit 13, a charge circuit 14, a discharge control unit 15, a storage unit 16, and a switch 17.

The relay 11 is a latching relay. According to a switching instruction from the power supply control unit 13, the relay 11 switches between a power supply state for supplying the external power to the AC-DC power supply 12, and a power cut-off state for not supplying the external power to the AC-DC power supply 12. Hereafter, when the relay 11 switches "on", the relay 11 switches to the power supply state, and when the relay 11 switches "off", the relay 11 switches to the power cut-off state.

Since the relay 11 is a latching relay, when the supply of power thereto is cut off after switching to a given state, the relay 11 remains in the state.

When the relay 11 is off, the AC-DC power supply 12 does not operate since the external power is not inputted thereto. When the relay 11 is on, the external power is inputted to the AC-DC power supply 12, and the AC-DC power supply 12 converts the inputted voltage (AC) into DC voltage. In this embodiment the AC-DC power supply 12 converts the inputted voltage into DC 24 V and DC 5 V, and outputs each converted voltage.

The power supply control unit 13 controls all power input and output to the power supply device 10, and controls charging and discharging of the secondary battery 30.

The charge circuit 14 is a circuit that, based on an instruction issued by the power control unit 13, charges the secondary battery 30 by using the DC 5 V supplied from the AC-DC power supply 12.

The discharge control unit 15 switches, according to an instruction issued by the power supply control unit 13, between a power supply state for supplying (discharging) energy accumulated in the secondary battery 30 to the I/F unit 22 of the device body 20, and a power supply stop state for stopping the supply (stopping the discharge) of energy accumulated in the secondary battery 30.

The storage unit 16 is a non-volatile memory in the present embodiment, and stores information such as the sleep mode time setting.

The switch 17 switches, according to an instruction issued by the power supply control unit 13, between a power supply state for supplying the DC 5 V from the AC-DC power supply 12 to the print unit 21 of the device body 20, and a power cut-off state for not supplying the DC 5 V from the AC-DC power supply 12 to the print unit 21. When the switch 17 switches "on", the switch 17 switches to the power supply state, and when the switch 17 switches "off", the switch 17 switches to the power cut-off state.

The secondary battery 30 has at least one cell that generates electricity through an electrochemical reaction that involves a pair of electrodes and electrolyte therein, and discharges (supplies) the electricity. The secondary battery 30 is charged when current is supplied across the pair of electrodes. In the present embodiment, the secondary battery 30 includes three cells connected in series, and requires a voltage greater than or equal to 5 V to be fully charged. Note that the secondary battery 30 to be installed to the image forming device may be a nickel-hydrogen battery for example, or may be another type of battery. Also, the secondary battery 30 may be fixed to the image forming device, or may be detachably attached to the image forming device.

(4) Configuration of Power Supply Control Unit 13

The power supply control unit 13 includes a mode switching unit 131, a charge circuit switching unit 132, a battery voltage detection unit 133, and a clock IC 134.

The mode switching unit 131 switches a mode of the image forming device between a plurality of modes, including the sleep mode, a low power mode, and an operation mode.

Figure 2:
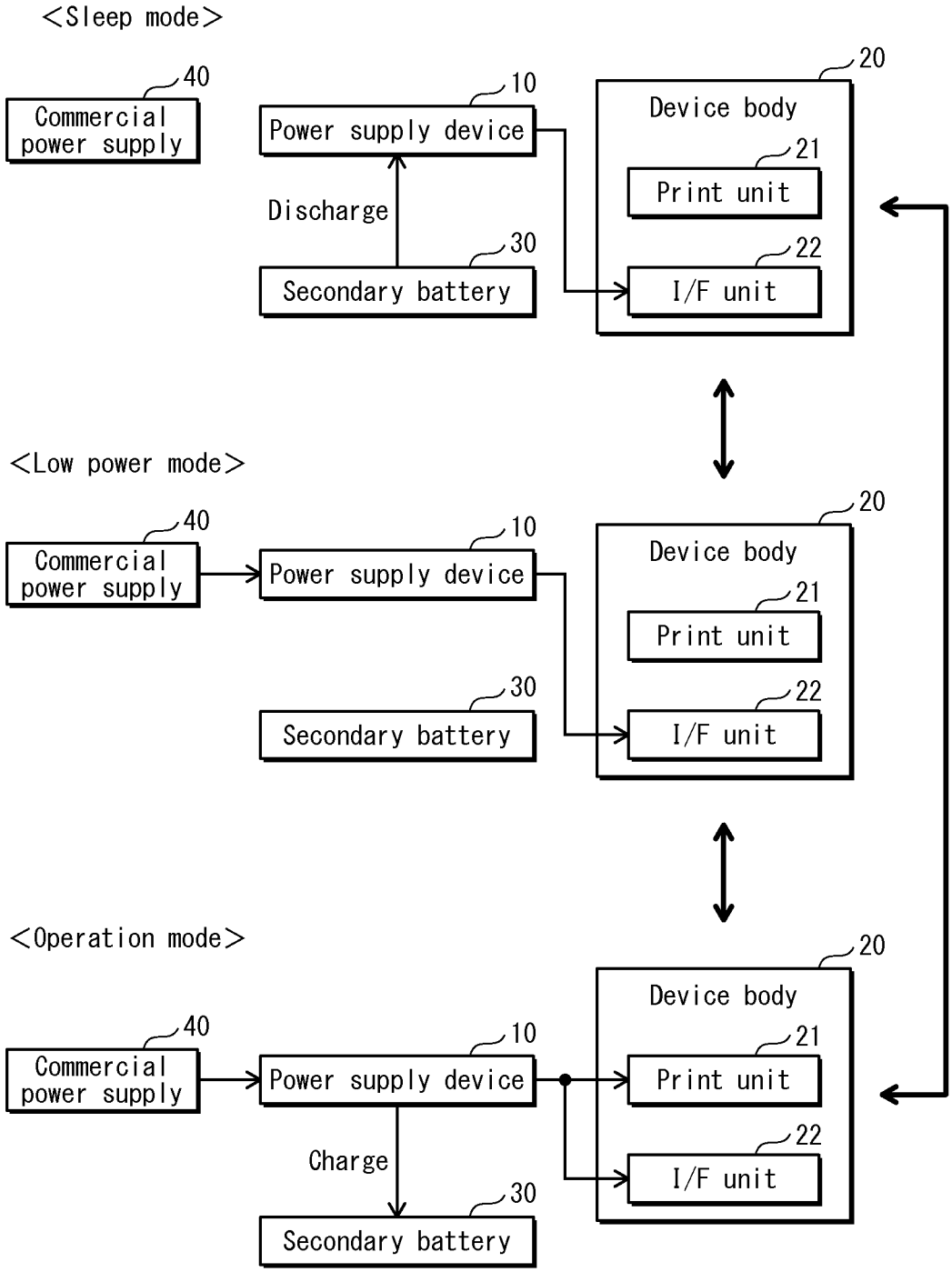
FIG. 2 is a schematic diagram illustrating switching between a sleep mode, a low power mode, and an operation mode.

FIG. 2 is a schematic diagram illustrating the switching between the modes.

As illustrated in FIG. 2, when the image forming device is in the sleep mode, the external power (power output from the commercial power supply 40) is not supplied to the power supply device 10 and the device body 20, while power from the secondary battery 30 is discharged and supplied to the I/F unit 22 via the power supply device 10. When the image forming device is in the sleep mode, the consumption of the external power (power output from the commercial power supply 40) by the image forming device is zero.

Accordingly, by setting the sleep mode with respect to time periods, such as time periods corresponding to non-business hours, during which it is expected that job execution requests would be infrequently made from users (request frequency is low), so-called "standby" consumption of the external power that is supplied to the power supply device 10 and the device body 20 is prevented, and a large amount of electricity is conserved.

Of course, the I/F unit 22 operates even during the sleep mode, by power being supplied from the secondary battery 30. Therefore in cases where there is a user working outside of business hours and there is an execution request for printing from such a user, or where an execution request for an image forming job is received due to, for example, the reception of a facsimile from an external source, such execution requests are received and convenience is not reduced for users.

As described above, the sleep mode is executed during a time period that is set in advance, such as from 6 p.m. on a given day until 9 a.m. the following day. When the end time of the sleep mode is reached, the sleep mode ends, and the image forming device switches to the low power mode.

When the image forming device is in the low power mode, the external power is supplied to the I/F unit 22 of the device body 20 via the power supply device 10, while the external power is not supplied to the print unit 21. Further, in the lower power mode, power from the secondary battery 30 is not supplied to the power supply device 10 or the device body 20, and the charging of the secondary battery 30 is also not performed.

When the image forming device is in the low power mode, since power from the secondary battery 30 is not supplied to the I/F unit 22, etc., a decrease in capacity of the secondary battery 30 (amount of energy accumulated in the secondary battery 30) is suppressed.

Also, since the external power is not supplied to the print unit 21 in the low power mode, the external power can be prevented from being unnecessarily consumed as standby power. Elements of the print unit 21 that may consume standby power include a circuit substrate provided to the print control unit 54 of the print unit 21, and a sensor provided to the image forming unit 51.

Thus, while the energy conservation of the low power mode is not as effective as that of the sleep mode, which is a power conservation mode, the low power mode also conserves energy and is also a power conservation mode.

When the image forming device is in the low power mode and an execution request for an image forming job is received by the I/F unit 22, the image forming device switches to the operation mode.

When the image forming device is in the operation mode, the external power is supplied to both the print unit 21 and the I/F unit 22 of the device body 20 via the power supply unit 10, and further, the secondary battery 30 is charged. Accordingly, in the operation mode, a received image forming job is executed by the print unit 21, and even during the execution of the image forming job, execution requests for other image forming jobs can be received by the I/F unit 22.

When the image forming job is completed, the image forming device returns to the low power mode. Subsequently, when an execution request for another image forming job is received while the image forming device is in the low power mode, the image forming device again switches to the operation mode and executes the received image forming job. Until the start time of the next sleep mode, the image forming device alternates between the low power mode and the operation mode in such a manner.

When the image forming device is in the low power mode and the start time of the sleep mode is reached, the image forming device switches to the sleep mode. Furthermore, when the start time of the sleep mode is reached while the image forming device is executing an image forming job in the operation mode, the image forming device switches to the sleep mode after the operation mode ends due to the image forming job being completed. Furthermore, when an execution request for an image forming job is received when the image forming device is in the sleep mode, the switching between modes is controlled such that the image forming device temporarily switches to the operation mode to execute the image forming job, and then returns to the sleep mode again when the image forming job is completed.

Also, when the image forming device is in the operation mode and executing an image forming job at the point when the end time of the sleep mode is reached, the image forming device switches to the low power mode after the operation mode ends due to the image forming job being completed. When the image forming device is not in the operation mode at the point when the end time of the sleep mode is reached, the image forming device switches to the low power mode. In this way, the power supply control unit 13 uses the commercial power supply 40 and the secondary battery 30 as drive sources, and functions as a unit for switching the image forming device between the sleep mode, the operation mode, and the low power mode.

Note that a large amount of power is supplied from the power supply device 10 to the device body 20 when the image forming device is in the operation mode, such as around 1000 W, while a relatively small amount of power is supplied to the I/F unit 22 when the image forming device is in the low power mode or the sleep mode, such as around 1 W.

In the present embodiment, description is provided assuming that the sleep mode is not only set with respect to a specific time within each day, but also with respect to the entire day on Saturday and Sunday, which are set in advance as non-working days. Therefore, every Saturday and Sunday, if there are no image forming jobs executed, the sleep mode automatically continues throughout the day.

Note that the user is able to use the operator input unit 53 to select the non-execution of the sleep mode. When such a setting is selected, the sleep mode is not executed and only other modes are executed.

The switching between modes is performed by switching such elements as the relay 11 and the switch 17, shown in FIG. 1.

Specifically, when switching to the operation mode, the mode switching unit 131 switches on both the relay 11 and the switch 17. The relay 11 is switched based on a switching instruction signal from an output terminal P0 of the power supply control unit 13. The switch 17 is switched based on a switching instruction signal from an output terminal P2 of the power supply control unit 13.

As such, in the operation mode, the external power is inputted to the AC-DC power supply 12, and therefore the AC-DC power supply 12 outputs the DC 24 V and the DC 5 V.

In the operation mode, the DC 24 V from the AC-DC power supply unit 12 is supplied to the print unit 21, and the DC 5 V from the AC-DC power supply unit 12 is supplied to the print unit 21, the I/F unit 22, the power supply control unit 13, and the charge circuit 14. Thus, when the image forming device is in the operation mode, the power supply control unit 13 operates by using the DC 5 V supplied from the AC-DC power supply 12 as a drive source.

In the operation mode, by the DC 5 V being supplied from the AC-DC power supply 12 to the charge circuit 14, charging of the secondary battery 30 is performed.

In the operation mode, the print unit 21 operates by using the DC 24 V and the DC 5 V supplied from the AC-DC power supply 12 as a drive source.

In the operation mode, the I/F unit 22 operates by using the DC 5 V from the AC-DC power supply 12 as a drive source. Specifically, the I/F control unit 62 steps down the DC 5 V from the AC-DC power supply 12 to a voltage suitable for operation of the I/F 61, for example 3V, and supplies the stepped-down voltage to the I/F 61. This similarly applies to when the image forming device is in the sleep mode and power from the secondary battery 30 is supplied to the I/F unit 22.

Further, in the operation mode, the mode switching unit 131 controls the discharge control unit 15, and causes the discharge control unit 15 to stop discharge of the secondary battery 30. The discharge control unit 15 stops discharge of the secondary battery 30 based on a discharge/stop switching signal from an output terminal P5 of the power supply control unit 13.

When switching to the low power mode, the mode switching unit 131 leaves the relay 11 on, switches the switch 17 off, and issues an instruction that causes the AC-DC power supply 12 to stop outputting the DC 24 V. The AC-DC power supply 12 stops outputting the DC 24 V based on a switching instruction signal from an output terminal P1 of the power supply control unit 13. Thus, in the low power mode, the supply of the DC 24 V and the DC 5 V from the AC-DC power supply 12 to the print unit 21 is stopped.

Note that when the image forming device is in the low power mode, supply of the DC 5 V from the AC-DC power supply 12 to the power supply control unit 13 and the I/F unit 22 continues. Thus, when the image forming device is in the low power mode, the power supply control unit 13 operates by using the DC 5 V from the AC-DC power supply 12. Supply of the DC 5 V from the AC-DC power supply 12 to the charge circuit 14 also continues when the image forming device is in the low power mode, but due to a switching instruction that is later described being transmitted to the charge circuit 14, charging of the secondary battery 30 is inhibited in the low power mode. Furthermore, as in the operation mode, when the image forming device is in the low power mode, the discharge control unit 15 is controlled such that the discharge control unit 15 stops discharge of the secondary battery 30.

Therefore the power of the secondary battery 30 is not expended by the I/F unit 22, etc., in the low power mode.

When switching to the sleep mode, the mode switching unit 131 switches the relay 11 off. Due to this, in the sleep mode, input of the external power to the AC-DC power supply 12 is stopped, which stops the output of the DC 24 V and the DC 5 V from the AC-DC power supply 12.

Also, when switching to the sleep mode, in addition to switching the relay 11 off, the mode switching unit 131 controls the discharge control unit 15 such that the secondary battery 30 is discharged. The discharge control unit 15 starts discharge of the secondary battery 30 based on the discharge/stop switching signal from the output terminal P5 of the power supply control unit 13.

In the sleep mode, due to the discharge of the secondary battery 30, power from the secondary battery 30 is supplied to the power supply control unit 13, via a PA2 terminal of the power supply control unit 13, and to the I/F unit 22, via the discharge control unit 15. Thus, when the image forming device is in the sleep mode, each of the power supply control unit 13 and the I/F unit 22 operates by using power from the secondary battery 30 as a drive source.

Note that, as shown in FIG. 1, a circuit configuration is adopted in the present embodiment such that a power line 32, along which current output from the secondary battery 30 flows, is joined to a power line 31 at a node 33. The power line 31 connects the AC-DC power supply 12 and the I/F unit 22. Due to adopting such a configuration, a diode 18 is provided on the power line 31 to prevent, when the image forming device is in the sleep mode, the current output from the secondary battery 30 from flowing in reverse toward the AC-DC power supply 12 along the power line 31, via the power line 32 and the node 33.

The mode switching unit 131 causes the image forming device to switch to the operation mode from the low power mode upon receiving an execution request reception notification for an image forming job from the I/F unit 22, via a PA3 terminal of the power supply control unit 13. Note that similar to the switching from the low power mode to the operation mode, the switching from the sleep mode to the operation mode is triggered by the execution request reception notification being received while the image forming device is in the sleep mode.

The print unit 21, due to the switch to the operation mode, is supplied power required to execute an image forming job, from the power supply device 10. In the present embodiment, the print unit 21 is supplied the DC 24 V and the DC 5 V from the AC-DC power supply 12 in the operation mode. Thus, in the operation mode, when receiving job data from the I/F unit 22, the print unit 21 executes an image forming job based on the job data received. The print unit 21, upon completing the image forming job, transmits a job completion notification indicating the completion of the image forming job to the power supply control unit 13.

The mode switching unit 131 of the power supply control unit 13, upon receiving the job completion notification, causes the image forming device to switch from the operation mode to the low power mode. Note that similar to the switching from the operation mode to the lower power mode, the switching from the operation mode to the sleep mode is also triggered by the job completion notification being received while the image forming device is in the operation mode.

The charge circuit switching unit 132 performs a control of switching a charging method according to which the charge circuit 14 charges the secondary battery 30 between a first control and a second control (such control hereafter referred to as a "charging method switching control"). Detailed explanation of the configuration of the charge circuit 14 and the charging method switching control is provided in the following sections.

The battery voltage detection unit 133 detects the current voltage of the secondary battery 30 via a PA3 terminal of the power supply control unit 13. The result of the detection is used in the charging method switching control.

The clock IC 134 has a function of clocking the current time, and a calendar function that includes calendar information for each day. The calendar information for a given day indicates, for example, the date of the given day and the day of the week of the given day. The time clocked and the calendar information, etc., are used in the charging method switching control.

Explanation of the sleep mode, the low power mode, and the operation mode is given above, but the image forming device is also switchable to two other modes, a supplemental charging mode and an urgent charging mode. The supplemental charging mode and the urgent charging mode are modes that are executed when the execution of the sleep mode has been selected. Details of the supplemental charging mode and the urgent charging mode are given later.

Also, the power supply control unit 13 is able to exchange signals with the device body 20. For example, in addition to the job completion notification and the execution request reception notification, the power supply control unit 13 receives the timing information including the start and end time of the sleep mode, and information (selection information) on whether the execution or the non-execution of the sleep mode has been selected by the user through the operator input unit 53. Further, the power supply control unit 13 writes the timing information and the selection information that are received to the storage unit 16.

Furthermore, the power supply control unit 13, upon receiving the DC 5 V from the AC-DC power supply 12 when the relay 11 is on, detects that the external power is being supplied.

(5) Configuration of Charge Circuit 14

As shown in FIG. 1, the charge circuit 14 includes a switch 81, a voltage boost circuit 82, and a constant current circuit 83.

The switch 81 and the voltage boost circuit 82 are connected in parallel, and the constant current circuit 83 is connected in series to the switch 81 and the voltage boost circuit 82.

The switch 81 intermittently connects and disconnects, and thereby switches between a state for conducting or not conducting the DC 5 V from the AC-DC power supply 12, based on a circuit switching signal from an output terminal P3 of the power supply control unit 13. When the switch 81 switches "on", the switch 81 switches to a connected state, and when the switch 81 switches "off" the switch 81 switches to a disconnected state.

The voltage boost circuit 82 is a DC-DC converter that boosts the DC 5 V from the AC-DC power supply 12 to a predetermined voltage, which in this embodiment is 5.4 V. The voltage boost circuit 82 includes, for example, a driver IC (not illustrated) for boosting the voltage. The voltage boost circuit 82 has a function of switching between operating and stopping based on an operate/stop switching signal from an output terminal P4 of the power supply control unit 13.

Specifically, when the voltage boost circuit 82 receives an instruction to switch from stopping to operating by receiving the operate/stop switching signal from the power supply control unit 13, the driver IC operates and the DC 5 V from the AC-DC power supply 12 inputted to the voltage boost circuit 82 is boosted to DC 5.4 V and outputted (operation of the voltage boost circuit 82).

On the other hand, when the voltage boost circuit 82 receives an instruction to switch from operating to stopping by receiving the operate/stop switching signal from the power supply control unit 13, the driver IC stops operating and the output of voltage from the voltage boost circuit 82 is stopped (stopping operation of the voltage boost circuit 82)

The constant current circuit 83 is a circuit for maintaining a charge current for charging the secondary battery 30 at a constant current value, determined in advance as a value suitable for charging the secondary battery 30, and outputting the constant current.

In such a circuit configuration, when the operation of the voltage boost circuit 82 is stopped while switching the switch 81 on, the DC 5 V from the AC-DC power supply 12 is supplied to the secondary battery 30 via the switch 81 and the constant current circuit 83. This charging method is the first control.

In contrast, when the voltage boost circuit 82 is switched to operate while switching the switch 81 off, the DC 5 V from the AC-DC power supply 12 is boosted to 5.4 V by the voltage boost circuit 82, and then supplied to the secondary battery 30 via the constant current circuit 83. This charging method is the second control.

The charge circuit switching unit 132 performs the charging method switching control by switching the switch 81 on and off and switching the voltage boost circuit 82 between operating and stopping. Thus, the charge circuit 14 and the power supply control unit 13 can be said to function as a unit for charging the secondary battery 30.

Note that during a period where the secondary battery 30 is not to be charged, the switch 81 is switched off, and the operation of the voltage boost circuit 82 is stopped. Accordingly, the DC 5 V from the AC-DC power supply 12 is not supplied to the secondary battery 30 via the charge circuit 14.

Also, provided that the charge circuit 14 is able to switch between boosting and not boosting voltage input thereto, the configuration of the charge circuit 14 is not limited to the configuration described above.

For example, the charge circuit 14 may be configured to include the switch 81 connected in parallel to a series circuit that includes the voltage boost circuit 82 and another switch (not illustrated) different to those described above. In this configuration, the first control is performed by switching the switch 81 on and switching the other switch off, and the second control is performed by switching the switch 81 off and switching the other switch on. Thus, switching between the first control and the second control is realized. Further, such a configuration allows the use of a voltage boost circuit that does not have a function of switching between operating and stopping based on an operate/stop signal.

In the present embodiment, switching between the first control and the second control is performed during the charging of the secondary battery 30, according to a value indicative of the amount of energy in the secondary battery 30. Specifically, in the present embodiment, the voltage of the secondary battery 30 is used as the value indicative of the amount of energy of the secondary battery 30. By switching the charging method in such a manner, a decrease in charging efficiency brought about by voltage conversion loss resulting from the boosting of voltage by the voltage boost circuit 82 is suppressed, and charging efficiency is therefore improved. The following is a specific explanation of the reasons.

(6) Switching of Charging Method

Figure 3A:
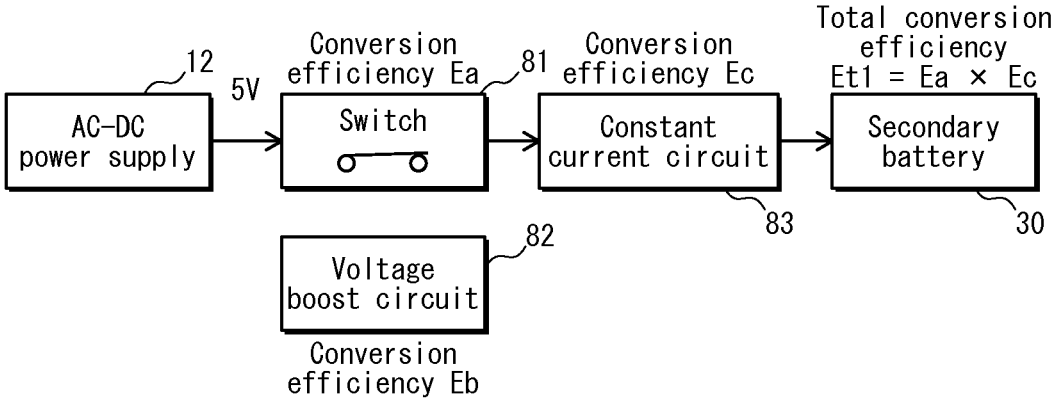
FIG. 3A is a diagram illustrating a circuit block when charging a secondary battery by using a first control.
Figure 3B:
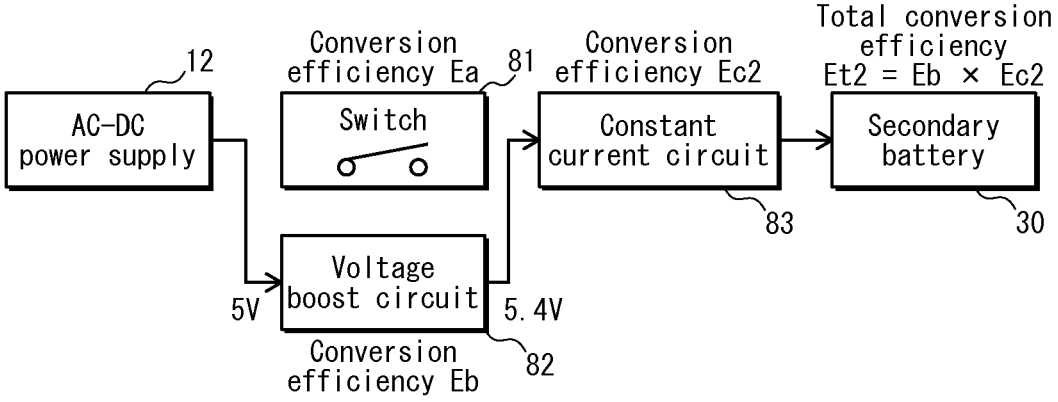
FIG. 3B is a diagram illustrating a circuit block when charging the secondary battery by using a second control.

FIG. 3A is a diagram illustrating a circuit block when charging the secondary battery 30 by using the first control, and FIG. 3B is a diagram illustrating a circuit block when charging the secondary battery 30 by using the second control.

As shown in FIG. 3A, in the first control, the voltage boost circuit 82 is not used, and the DC 5 V from the AC-DC power supply 12 is supplied to the secondary battery 30 via the switch 81 and the constant current circuit 83. When denoting a conversion efficiency of the switch 81 as Ea, denoting a conversion efficiency of the constant current circuit 83 as Ec, and denoting the total conversion efficiency in the first control as Et1, Et1=Ea×Ec.

The conversion efficiency is an indicator of an average of a ratio of output power to input power, expressed as a percentage, within a charging time of the secondary battery 30. As current flows through circuit elements (the switch 81, the voltage boost circuit 82, and the constant current circuit 83), power loss occurs including heat losses caused by resistance and conversion losses when converting voltages. The greater the power loss, the lower the conversion efficiency.

For example, when the conversion efficiency Ea of the switch 81 is 98% and the conversion efficiency Ec of the constant current circuit 83 is 90%, the total conversion efficiency Et1 is 88%.

On the other hand, as shown in FIG. 3B, in the second control, the voltage boost circuit 82 is used instead of the switch 81, which is used in the first control. Therefore, the DC 5 V from the AC-DC power supply 12 is supplied to the secondary battery 30 via the voltage boost circuit 82 and the constant current circuit 83.

When denoting a conversion efficiency of the voltage boost circuit 82 as Eb, denoting a conversion efficiency of the constant current circuit 83 as Ec2, and denoting the total conversion efficiency in the second control as Et2, Et2=Eb×Ec2.

An explanation follows of why the conversion efficiency Ec2 of the constant current circuit 83, when the second control is performed, differs from the conversion efficiency Ec of the constant current circuit 83, when the first control is performed.

The voltage inputted to the constant current circuit 83 differs between the first control and the second control.

Specifically, when the first control is performed, the DC 5 V from the AC-DC power supply 12 is supplied to the constant current circuit 83, and when the second control is performed, 5.4 V is supplied to the constant current circuit 83. Under normal conditions, the constant current circuit 83 has a characteristic such that the greater a difference ΔV between the voltage inputted thereto and the voltage of a load at the output side thereof (in this case, the voltage of the secondary battery 30), the greater the power loss across the constant current circuit 83. Accordingly, if the voltage of the secondary battery 30 (the voltage at the output side of the constant current circuit 83) is the same between the first control and the second control, the voltage difference ΔV is greater in the second control than in the first control.

Accordingly, the conversion efficiency Ec2 of the constant current circuit 83, when the second control is performed, is lower than the conversion efficiency Ec of the constant current circuit 83, when the first control is performed; proportionate to the voltage difference ΔV between the second control and the first control.

For example, when the conversion efficiency Eb of the voltage boost circuit 82 is 90% and the conversion efficiency Ec2 of the constant current circuit 83 is 89% (lower than the conversion efficiency Ec as described above), the total conversion efficiency Et2 is 80%. A low total conversion efficiency indicates a low charging efficiency of the secondary battery 30.

Looking at only the charging efficiency, it seems that the first control is superior to the second control. However, in the first control, the charging of the secondary battery 30 is performed by using the DC 5 V inputted to the charge circuit 14 from the AC-DC power supply 12. Thus, when taking into account a slight voltage drop that occurs across the constant current circuit 83 (a decrease of about 0.4 V), the actual voltage applied to the secondary battery 30 is approximately 4.6 V. This is not enough to fully charge the secondary battery 30 since the secondary battery 30 requires at least 5 V to be fully charged.

On the other hand, in the second control, a voltage of 5.4 V is inputted to the constant current circuit 83 due to the boosting of voltage. Thus, even if a 0.4 V voltage drop occurs across the constant current circuit 83, the actual voltage applied to the secondary battery 30 is maintained to equal to or above 5 V, and therefore the secondary battery 30 can be fully charged. However, since the total conversion efficiency Et is lower in second control than in the first control as described above, the second control is inferior to the first control in terms of charging efficiency.

Charging of the secondary battery 30 can be performed by supplying a voltage that is higher than the current voltage of the secondary battery 30 during charging. Further, the voltage of the secondary battery 30 during charging is substantially the same as the voltage across the output terminals of the constant current circuit 83. Thus, the voltage of the secondary battery 30 at a given time point during charging is acquirable by detecting the voltage across the output terminals of the constant current circuit 83 at the time point.

Accordingly, within a time period from the start of charging of the secondary battery 30 until the voltage of the secondary battery 30 reaches 4.6 V (referred to as a first section), high charging efficiency is achieved by performing the first control.

Further, by performing the second control after the voltage of the secondary battery 30 reaches 4.6 V, the secondary battery 30 can be fully charged.

As described above, the charging efficiency of the second control is lower than that of the first control. However, according to the present embodiment, the second control is only used for a limited time period from when the voltage of the secondary battery 30 reaches 4.6 V until the secondary battery 30 is fully charged (referred to as a second section).

Also, the image forming device pertaining to the present embodiment is configured to perform the second control from the point when the voltage of the secondary battery 30 reaches 4.6 V. Since the input voltage of the constant current circuit 83 at the point when the voltage of the secondary battery 30 reaches 4.6 V is 5 V, the difference ΔV is only 0.4 V. This difference ΔV of 0.4 V is considerably smaller than the difference ΔV in a case where, for instance, charging of the secondary battery 30 is started while the voltage of the secondary battery 30 is low, such as 3 V (the difference ΔV in such a case is 2V). Since the difference ΔV is extremely small as described above, the power loss across the constant current circuit 83 is extremely small. As such, such a configuration is advantageous in terms of charging efficiency.

Thus, a large drop in charging efficiency is not brought about even when switching from the first control to the second control during the charging of the secondary battery 30. Further, the charging efficiency when performing the switching from the first control to the second control during the charging of the secondary batter 30 is higher than the charging efficiency when performing only the second control throughout the entirety of the charging of the secondary battery 30.

In FIGS. 3A and 3B, illustration is provided while assuming that when the voltage of the secondary battery 30 reaches DC 4.6 V, the capacity of the secondary battery (the amount of energy accumulated in the secondary battery 30) is 80% of the capacity (100%) when the secondary battery 30 is fully charged. In other words, in FIGS. 3A and 3B, DC 4.6 V is assumed to be a voltage corresponding to 80% of the amount of energy of the secondary battery 30 when fully charged. Further, FIGS. 3A and 3B indicate an example of a case where the range 0-80% of the amount of energy of the secondary battery 30 is set as the first section, during which the first control is performed, and the range 80-100% of the amount of energy of the secondary battery 30 is set as the second section, during which the second control is performed.

Figure 4:
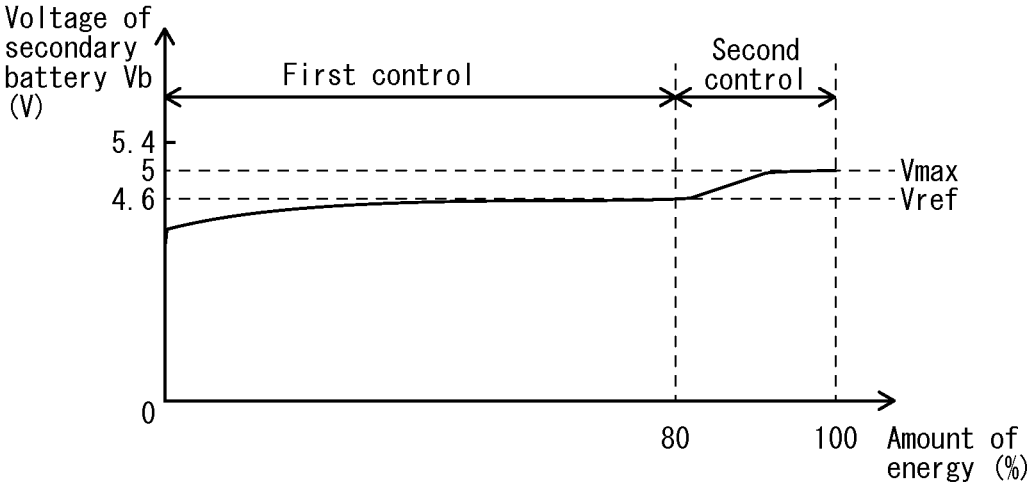
FIG. 4 is a graph illustrating the relationship between an amount of energy (%) and a voltage Vb (V) of the secondary battery when charging of the secondary battery is performed by switching between the first control and the second control.
Figure 5:
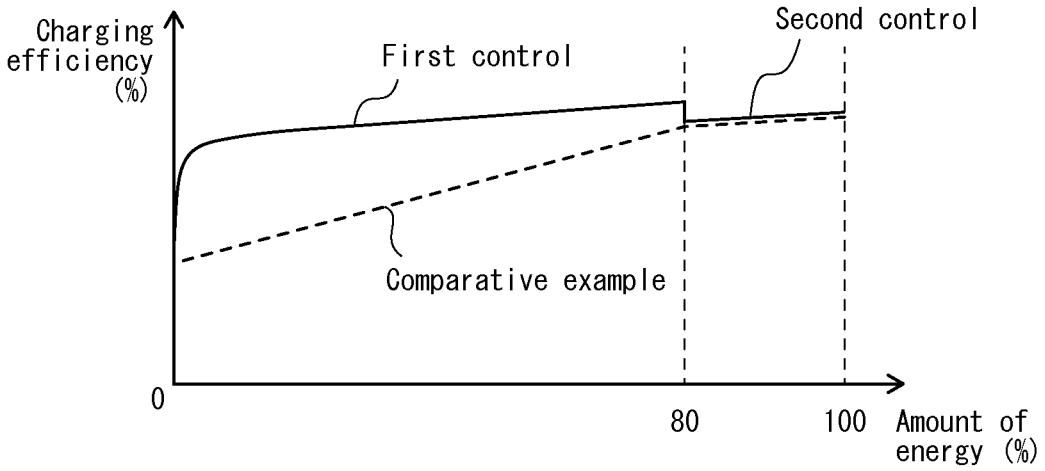
FIG. 5 is a graph illustrating the relationship between the amount of energy (%) of the secondary battery and charging efficiency (%) when charging of the secondary battery is performed by switching between the first control and the second control.

FIG. 4 is a graph illustrating the relationship between the amount of energy (%) and a voltage Vb of the secondary battery 30 when the charging of the secondary battery 30 is performed by switching between the first control and the second control. FIG. 5 is a graph illustrating the relationship between the amount of energy (%) of the secondary battery 30 and charging efficiency (%) when charging of the secondary battery 30 is performed by switching between the first control and the second control. Both graphs are derived from experimental measurements. Here, in FIG. 5, the charging efficiency is a ratio of the output power of the charge circuit 14 to the input power of the charge circuit 14, expressed as a percentage. The graph illustrating the charging efficiency plots values of the charging efficiency calculated at fixed time intervals.

As shown in FIG. 4, until the amount of energy of the secondary battery 30 reaches 80% (excluding values around 0%), the voltage Vb of the secondary battery 30 gradually increases due to the first control being performed. Further, it can be seen that when the voltage Vb reaches 4.6 V, the amount of energy of the secondary battery 30 reaches 80%.

In addition, it can be seen that while the amount of energy of the secondary battery 30 is between 80% and 100%, the voltage Vb rapidly increases immediately after the switching from the first control to the second control, and then is maintained stably at a constant 5 V after reaching 5 V. Here, it is considered that the point when the voltage Vb stabilizes at 5 V corresponds to when the secondary battery 30 has been fully charged, or that is, when the amount of energy of the secondary battery 30 has reached 100%.

The 5 V and 4.6 V values of the voltage Vb of the secondary battery 30 in FIG. 4 show the voltages supplied to the secondary battery 30 after the voltages 5.4 V and 5 V input to the constant current circuit 83 are each reduced by 0.4 V due to the voltage drop across the constant current circuit 83.

In the following, the voltage DC 5 V corresponding to the voltage when the secondary battery 30 is fully charged is denoted as a full charge voltage Vmax, and a voltage that is the threshold for switching between the first control and the second control is denoted as a threshold voltage Vref.

As shown in FIG. 5, the charging efficiency is higher when the first control is performed than when the second control is performed. Further, when denoting the average charging efficiency when the first control is performed as a first average efficiency, the first average efficiency equals 88%, when calculated according to the graph in FIG. 5. Further, when denoting the average charging efficiency when the second control is performed as a second average efficiency, the second average efficiency equals 80%, when calculated according to the graph in FIG. 5. The first average efficiency and the second average efficiency correspond to Et1 and Et2, respectively.

FIG. 5 also shows, by using a dotted line, a charging efficiency when a charging method of a comparative example is used. The charging method of the comparative example is a method of using the second control for the full range (0-100%) of the amount of energy of the secondary battery 30.

Figure 6:
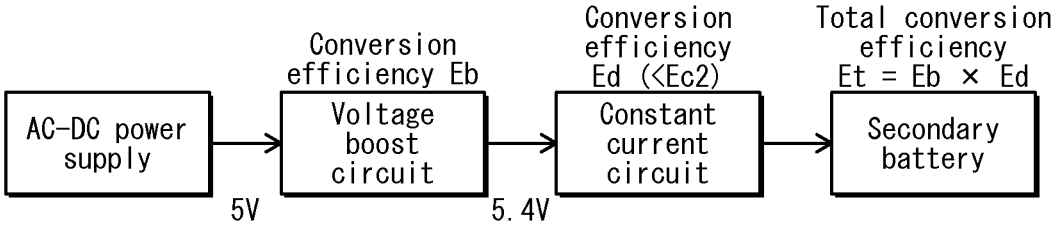
FIG. 6 is a diagram illustrating a circuit block when charging is performed according to a charging method of a comparative example.

FIG. 6 is a diagram illustrating a circuit block when charging is performed according to the charging method of the comparative example.

As shown in FIG. 6, the charging method of the comparative example is basically the same as when charging of the secondary battery 30 is performed by using the second control, as shown in FIG. 3B. However, in the charging method of the comparative example, the conversion efficiency Ed of the constant current circuit 83 is lower than the conversion efficiency Ec2 in the present embodiment. This is due to the following reason.

In the present embodiment, as shown in FIG. 4, the second control is performed when the voltage of the secondary battery 30 reaches 4.6 V (the threshold voltage Vref). Therefore the difference ΔV between the input voltage and the output voltage of the constant current circuit 83 is extremely small, and thus, the power loss across the constant current circuit 83 is low.

In the comparative example, however, the second control is performed from the start of charging of the secondary battery 30. Under normal conditions, the voltage of the secondary battery 30 upon the start of charging is nearly always less than 4.6 V. As such, when the second control is performed from the start of charging as in the charging method of the comparative example, the voltage difference ΔV is greater than when the second control is performed according to the present embodiment. Therefore, the power loss across the constant current circuit 83 is great and the charging efficiency is proportionally low.

As time elapses from the start of charging, the voltage of the secondary battery 30 increases, and the difference ΔV decreases accordingly. Therefore, as shown by the dotted line in the graph in FIG. 5, the charging efficiency of the charging method of the comparative example gradually increases. Nevertheless, when averaging the conversion efficiency throughout the period of charging, the conversion efficiency of the charging method of the comparative example is lower than the conversion efficiency Ec2 of the present embodiment.

Thus, it can be seen that the charging method of the present embodiment is more efficient at charging the secondary battery 30 than the charging method of the comparative example.

The above contains an explanation of an example where the threshold voltage Vref is set to 4.6 V, i.e. to the maximum voltage that can possibly be supplied to the secondary battery 30 by performing the first control, in which the voltage boost circuit 82 is not used, but the present invention is not limited in this way. For example, the threshold voltage Vref may be set to a voltage slightly lower than the maximum voltage. Alternatively, a voltage for the threshold voltage Vref that is suitable for device configuration and that is within a range of values improving charging efficiency may be determined in advance through experimentation, etc.

(7) Charging Method in Each Mode

FIG. 7 is a diagram illustrating the correspondence between modes of the image forming device and the charging methods.

As shown in FIG. 7, when the image forming device is in the operation mode, charging of the secondary battery 30 is performed by using the first control and the second control, and when the image forming device is in the low power mode and the sleep mode, charging of the secondary battery 30 is not performed. When the image forming device is in the supplemental charging mode, the charging method used for charging the secondary battery 30 varies depending upon the day of the week. When the image forming device is in the urgent charging mode, charging of the secondary battery 30 is performed by using only the first control.

The supplemental charging mode is a mode in which the secondary battery 30 is forcibly charged immediately before the image forming device switches to the sleep mode. The urgent charging mode is a mode in which the secondary battery 30 is forcibly charged during a period for execution of the sleep mode.

Figure 8:
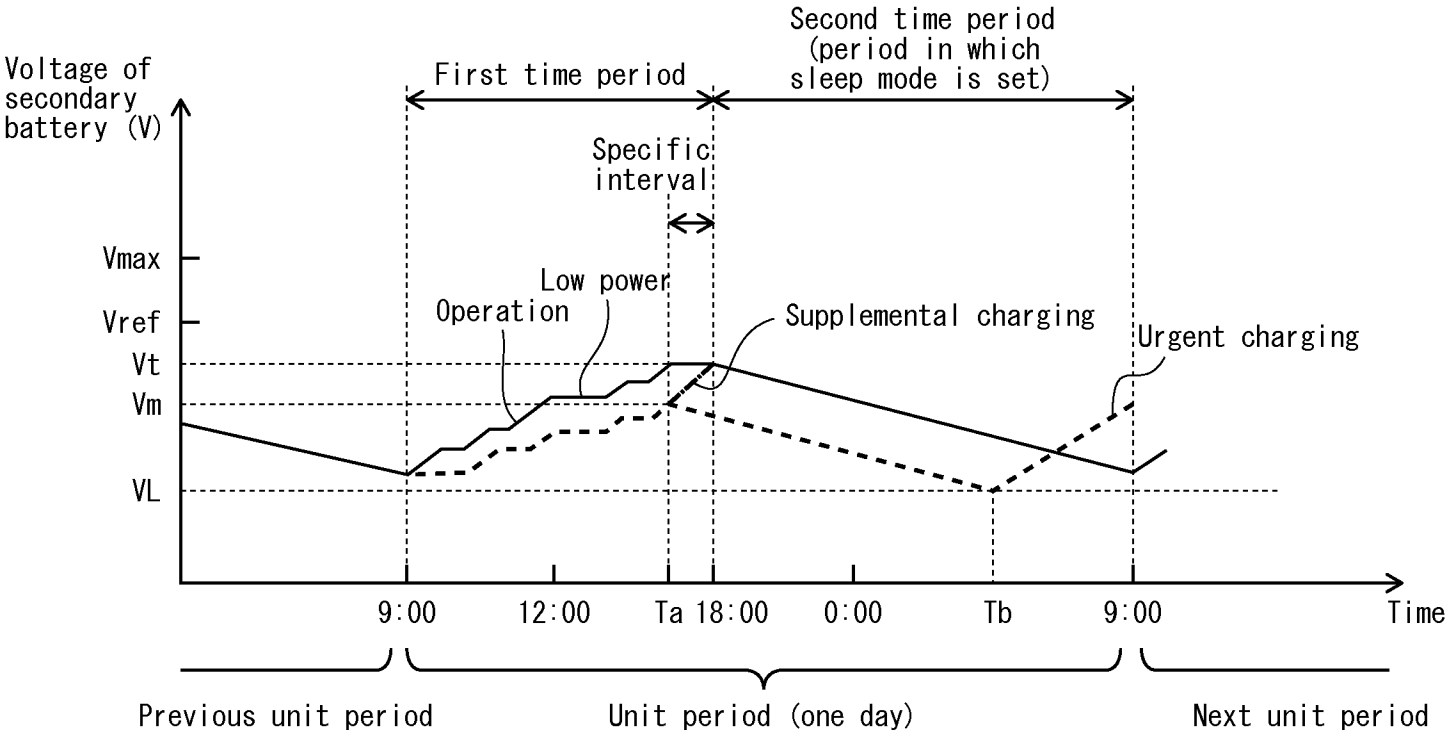
FIG. 8 is a diagram for explaining conditions of executing a supplemental charging mode and an urgent charging mode.

FIG. 8 is a diagram for explaining the conditions of executing the supplemental charging mode and the urgent charging mode. The horizontal axis indicates time, and the vertical axis indicates the voltage of the secondary battery 30. The diagram illustrates an example of how the voltage of the secondary battery 30 changes due to the switching between the modes.

FIG. 8 shows an example where one day (24 hours) is set as a predetermined unit period. In the example in FIG. 8, a user has set the start time of the sleep mode to 6 p.m., when working hours end, and the end time of the sleep mode to 9 a.m. the next day, when working hours begin. Further, in the example in FIG. 8, the period from 9 a.m. until 6 p.m. is set as a first time period (working hours), and a period from 6 p.m. until 9 a.m. the next day is set as a second time period (non-working hours) following the first time period.

The section within the first time period where the voltage of the secondary battery 30 is increasing corresponds to when the secondary battery 30 is being charged due to the image forming device being in the operation mode. The section within the first time period where the voltage of the secondary battery 30 is constant corresponds to when the power of the secondary battery 30 is not being depleted due to the image forming device being in the low power mode. Note that when the image forming device is in the low power mode, the power of the secondary battery 30 is not depleted by such loads as the I/F unit 22, and only a microscopic drop in voltage occurs due to self-discharge of the secondary battery 30. As such, the voltage of the secondary battery 30 in the low power mode is shown in FIG. 8 as a constant voltage.

Within the second time period, the power of the secondary battery 30 is depleted by such loads as the I/F unit 22, and therefore, the voltage of the secondary battery 30 continues to decrease.

The solid line in the graph in FIG. 8 shows a case where the voltage of the secondary battery 30 is increased to a target voltage Vt by the time the sleep mode starts (6 p.m.). In such a case, even if there are no opportunities for charging the secondary battery 30 during the second time period due to no image forming jobs being executed, the voltage of the secondary battery 30 is higher than a lower limit voltage VL at the end of the second time period, which is 9 a.m. the next day.

Here, the lower limit voltage VL is the lowest voltage in a voltage range ensuring normal operation of the I/F unit 22, and is a voltage such that, if the voltage of the secondary battery 30 were to drop below the lower limit voltage VL during the sleep mode, the I/F unit 22 would not be able to operate normally by using the power of the secondary battery 30. However, the lower limit voltage is not limited to being set to the lowest voltage as described above, and the lower limit voltage VL may be set to a predetermined voltage at which the I/F unit 22 is still able to operate normally, but below which the operating life of the secondary battery 30 would be affected (for example a discharge cut-off voltage of the secondary battery 30).

Further, the target voltage Vt is a voltage that corresponds to a sum of the lower limit voltage VL and a voltage Vd. The voltage Vd corresponds to a voltage drop that is estimated to occur when, from the start time to the end time of the sleep mode, the secondary battery 30 is not even charged once and thus, the voltage of the secondary battery 30 continues to drop due to continuous discharge. In the above example, the sleep mode has a duration of 15 hours.

By increasing the voltage of the secondary battery 30 to the target voltage Vt by the time the sleep mode starts, it is ensured that, even when the secondary battery 30 is not even charged once during the sleep mode, the voltage of the secondary battery 30 does not drop below the lower limit voltage VL and the I/F unit 22 operates normally by using the power supplied from the secondary battery 30, during the sleep mode.

Note that, for example, if by charging the secondary battery 30 for one hour a day, the I/F unit 22 and power supply control unit 13 are able to operate for the remaining 23 hours of the day by the secondary battery 30 discharging, the target voltage Vt may be set to the sum of the lower limit voltage VL and the increase in voltage when the secondary battery 30 is charged for one hour.

In such a case, for example, when the voltage of the secondary battery 30 is at least equal to the target voltage Vt at 6 p.m. on a given day, even if the secondary battery 30 is not charged from 6 p.m. until 5 p.m. the following day, the voltage of the secondary battery 30 is prevented from dropping below the lower limit voltage VL.

Further, values of the target voltage Vt and the lower limit voltage VL suitable for the device are to be determined in advance through experimentation, etc.

Note that according to calculation, when setting the target voltage Vt to (Vd+VL), the voltage of the secondary battery 30 exactly equals the lower limit voltage VL at 9 a.m., when the sleep mode ends, if no charging occurs during the sleep mode. However, since circumstances may differ from such calculation due to errors such as a detection error of the voltage of the secondary battery 30, it is desirable that the target voltage Vt be set in advance to a value higher than (Vd+VL), to an extent that allows for such errors.

Thus, the target voltage Vt may be set to a higher voltage than described above, and may be set for instance to the same voltage as the threshold voltage Vref. Nevertheless, FIG. 8 illustrates an example in which the target voltage Vt is set to a voltage lower than the threshold voltage Vref.

On the other hand, the dotted line in the graph in FIG. 8 shows a case where the voltage of the secondary battery 30 is lower than the target voltage Vt at 6 p.m., and at time Tb during the second time period, the voltage of the secondary battery 30 drops to the lower limit voltage VL. If the voltage were to continue to drop further after the time Tb, the voltage of the secondary battery 30 would drop below the lower limit voltage VL. This would result in the I/F unit 22 no longer being able to operate by using the power supplied from the secondary battery 30. Accordingly, the reception of an image forming job would become impossible.

Thus, when the voltage of the secondary battery 30 drops to the lower limit voltage VL during the sleep mode, urgent charging is performed of temporarily suspending the sleep mode and charging the secondary battery 30. The portion of the dotted line in the graph from the time Tb to 9 a.m. corresponds to a section in which the image forming device is in the urgent charging mode.

The urgent charging mode uses the same circuit configuration as the operation mode, i.e. in the urgent charging mode, power is supplied to the device body 20. However, the urgent charging mode differs from the operation mode in that image forming jobs are not executed.

When the urgent charging starts, the voltage of the secondary battery 30 is at the lower limit voltage VL, and therefore the difference ΔV between the input voltage and the output voltage of the constant current circuit 83 is great. Due to this, the charging efficiency when the secondary battery 30 is charged by using the urgent charging is low, reflecting the great voltage difference ΔV. Thus, the frequent execution of the urgent charging is undesirable in terms of charging efficiency.

Taking the above into account, in the present embodiment, configuration is made of enabling the execution of supplemental charging of preemptively charging the secondary battery 30 immediately before the start of the sleep mode in order to avoid performing the urgent charging. By enabling the execution of the supplemental charging, cases where the voltage of the secondary battery 30 drops below the lower limit voltage VL while the image forming device is in the sleep mode are avoided as much as possible.

Specifically, in the present embodiment, a configuration is made such that (i) when the start time of the sleep mode is 6 p.m. as in the case described above, at a predetermined time Ta prior to the start time of the sleep mode (in this case, at 5 p.m., which is one hour prior to 6 p.m.), a current voltage Vm of the secondary battery 30 is detected, and (ii) when the voltage Vm is lower than the target voltage Vt, charging of the secondary battery 30 is forcibly performed throughout a one-hour period until the start time of the sleep mode, whereby the voltage of the secondary battery 30 is increased toward the target voltage Vt (the amount of energy of the secondary battery 30 is increased). In FIG. 8, the portion of the dashed-dotted line in the graph from the time Ta to 6 p.m. corresponds to a section in which the image forming device is in the supplemental charging mode. This section is set in advance as a specific interval for supplemental charging, as a time section within one day (the unit period).

By increasing the voltage of the secondary battery 30 to the target voltage Vt by the start time of the sleep mode, i.e. 6 p.m., the voltage of the secondary battery 30 is prevented from dropping to the lower limit voltage VL after this point and until the end time of the sleep mode, i.e. 9 a.m. the next day, as in the case illustrated by the solid line in the graph in FIG. 8, even if the power of the secondary battery 30 is continuously depleted during the sleep mode.

Note that at the time Ta, at which the supplemental charging is started (in the above example, 5 p.m.), even when the voltage Vm of the secondary battery 30 is lower than the target voltage Vt, the voltage Vm is higher than the lower limit voltage VL. Accordingly, the difference ΔV between the input voltage and the output voltage of the constant current circuit 83 at the point when charging of the secondary battery 30 is started is smaller when the supplemental charging mode is performed than when the urgent charging mode is performed. Therefore, charging of the secondary battery 30 is performed at a higher efficiency in the supplemental charging mode than in the urgent charging mode. Conservation of energy is realized in the supplemental charging mode since, the higher the charging efficiency, the greater the amount of energy saved.

The supplemental charging is performed until either (i) the voltage of the secondary battery 30 reaches the target voltage Vt or (ii) the end time of the specific interval is reached (corresponding to the start time of the sleep mode, in the above example, 6 p.m.), whichever one of conditions (i) or (ii) occurs first.

On the other hand, the urgent charging is performed until either (i) the voltage of the secondary battery 30 reaches the target voltage Vt or (ii) the end time of the sleep mode is reached (in the above example, 9 a.m.), whichever one of (i) or (ii) occurs first. Further, when Vt<Vref, charging of the secondary battery 30 is performed according to the first control in either one of the supplemental charging and the urgent charging.

Note that when image forming jobs are executed at an extremely low frequency and thus, there are almost no opportunities to charge the secondary battery 30 during the first time period, the voltage of the secondary battery 30 remains low throughout the first time period. That is, there may be cases where the voltage of the secondary battery 30 does not reach the target voltage Vt even after the supplemental charging is performed for the one-hour period described above.

As described above, when the voltage of the secondary battery 30 drops to the lower limit voltage VL during the sleep mode, the image forming device switches to the urgent charging mode. Here, it should be noted that even in the above-described case, at the point when the image forming device switches to the sleep mode, the voltage of the secondary battery 30 has been increased to a certain extent due to the supplemental charging being performed immediately before switching to the sleep mode.

Accordingly, when compared to a case in which the supplemental charging is not performed, the arrival of the time Tb, at which the voltage of the secondary battery 30 drops to the lower limit voltage VL, is delayed, i.e. the time Tb is delayed so as to be closer to 9 a.m.

Until the time Tb is reached, the voltage of the secondary battery 30 is higher than the lower limit voltage VL. As such, by delaying the arrival of time Tb at least slightly by performing the supplemental charging, during the extra time before the time Tb afforded by the supplemental charging, the possibility increases of an execution request for a job such as facsimile reception being received during the night time, whereby charging of the secondary battery 30 is performed by the image forming device switching to the operation mode.

As such, in the above-described case, the likelihood increases of the switching to the urgent charging mode being avoided due to the supplemental charging being performed, compared to when not performing the supplemental charging. This is advantageous in the long term in terms of conservation of energy since, the greater the reduction in the number of executions of the urgent charging, the greater the amount of energy saved.

Here, further explanation is provided of the specific interval for the execution of the supplemental charging. First of all, the specific interval is set within the first time period. Further, the start time Ta of the specific interval is not limited to being set to one hour prior to the start time of the sleep mode. That is, provided that the start time Ta is prior to the start time of the sleep mode by a predetermined length of time, the start time Ta may be set to any time point, for example, 30 minutes prior to the start time of the sleep mode. Further, a configuration may also be made such that a user is able to set any time interval as the specific interval via the operator input unit 53, etc.

Returning to FIG. 7, when setting the unit period to one day as described above, the charging method used for charging the secondary battery 30 in the supplemental charging mode is varied depending upon the day of the week. More specifically, the supplemental charging is performed by using only the first control for each of Monday through Thursday, and the supplemental charging is performed by switching between the first control and the second control on Friday.

As described above, the charging method used in the supplemental charging mode depends upon the day of the week. More specifically, the charging method to be used in the supplemental charging in a given day of the week is determined while taking into account whether the next day is a "working day" as defined in the present disclosure (which is a day of the week that is not a non-working day, for example, a business day) or a non-working day (for example, a holiday).

For example, when assuming that the day (the current day: day 1) to which the time Ta (5 p.m.), which is the start time of the supplemental charging, belongs, is a working day, the next day (day 2) is a non-working day, and the day following the next day (day 3) is another working day, and when the sleep mode is set so as to be executed all day during non-working days, the sleep mode is set from 6 p.m. on day 1 until 9 a.m. on day 3, throughout a total of 39 hours.

During a non-working day, as in non-business hours, there are normally very few opportunities to charge the secondary battery 30 by the image forming device switching to the operation mode. As such, the secondary battery 30 discharges for a greater amount of time during a non-working day compared to during a working day, and thus, the likelihood is high during a non-working day of the secondary battery 30 being in a state where the voltage of the secondary battery 30 continues to drop.

In order to avoid the voltage of the secondary battery 30 dropping below the lower limit voltage VL even when the voltage of the secondary battery 30 continues to drop during a non-working day, it suffices to increase the amount of energy accumulated in the secondary battery 30 at the start of a non-working day as much as possible by charging the secondary battery 30 before the non-working day starts.

Specifically, it suffices to calculate a voltage Va1 in advance and to increase the voltage of the secondary battery 30 to the voltage Va1 by the start time of the sleep mode of the current day (6 p.m.). Here, the voltage Va1 is a sum of the lower limit voltage VL and a voltage Vd1. The voltage Vd1 corresponds to a voltage drop that is estimated to occur when, from 6 p.m. the current day until 9 a.m. of the day following the next day, the secondary battery 30 is not even charged once and thus, the voltage of the secondary battery 30 continues to drop due to continuous discharge Here, the voltage Va1 may, for instance, be set to the threshold voltage Vref.

This similarly applies to when not only one non-working day, but, for example, two non-working days follow the current day, or more specifically, when the current day is a Friday (a working day), the next day, which is a Saturday, and the day following the next day, which is a Sunday, are both non-working days, and Monday the following week is a working day. In such a case, the sleep mode is set from 6 p.m. on Friday (the current day) until 9 a.m. on Monday the following week, throughout a total of 63 hours.

Accordingly, in such a case, it suffices to calculate a voltage Va2 (a target value for non-working days), which is a sum of the lower limit voltage VL and a voltage Vd2, in advance. Here, the voltage Vd2 corresponds to a voltage drop that is estimated to occur when, from 6 p.m. on Friday (the current day) until 9 a.m. on Monday the following week, the voltage of the secondary battery 30 continues to drop due to continuous discharge With regards to the secondary battery 30 in the present embodiment, the voltage Va2 corresponds to the full charge voltage Vmax. However, an appropriate value for the voltage Va2 may be determined while taking into account device configuration, and for example, the voltage Va2 may be set to a voltage lower than the full charge voltage Vmax and higher than the target voltage Vt.

In the present embodiment, the sleep mode is set with respect to non-working days, or more specifically, the image forming device is in the sleep mode during Saturday and Sunday. As such, in the present embodiment, the voltage Va2 is set to the full charge voltage Vmax, and on Friday, which is the day before the two consecutive non-working days of Saturday and Sunday, the supplemental charging is performed by using not only the first control but also the second control and such that the voltage of the secondary battery 30 is increased to the full charge voltage Vmax, or in other words, the secondary battery 30 is fully charged.

On the other hand, on each of days such as Monday through Thursday, there are opportunities for charging the secondary battery 30 during the business hours (the first time period) during the following day since the following day is a working day. Therefore, there is no need to perform the supplemental charging such that the secondary battery 30 is fully charged on each of such days, and thus, the supplemental charging is performed by using the first control such that the voltage of the secondary battery 30 is increased to the target voltage Vt.

The secondary battery 30 typically has a characteristic such that charging load of the secondary battery 30 is lower when the voltage of the secondary battery 30 during charging is low compared to when the voltage of the secondary battery 30 during is high. Further, the secondary battery 30 has a characteristic such that low charging load is beneficial for the operating life of the secondary battery 30. Accordingly, the operational life of the secondary battery 30 can be at least slightly extended by performing the supplemental charging such that the voltage of the secondary battery 30 is only increased up to the target voltage Vt (<Vmax), which is the minimum necessary voltage of the secondary battery 30, on certain days, such as days followed by a working day, where there is no need to perform the supplemental charging such that the secondary battery 30 is fully charged.

Accordingly, within a given week, the supplemental charging is performed such that the secondary battery 30 is fully charged only on Friday, which is followed by two consecutive non-working days, whereas the supplemental charging is performed such that the secondary battery 30 is not fully charged on each day from Monday to Thursday.

Note that in FIG. 8, an example is shown where charging of the secondary battery 30 is not performed at all during the sleep mode, but in actual implementation, an image forming job such as facsimile reception may be received while the image forming device is in the sleep mode. In such a case, upon reception of the image forming job, the image forming device temporarily switches to the operation mode, and thus, charging of the secondary battery 30 is performed. Therefore, the voltage of the secondary battery 30 increases in proportion to the increase in the amount of energy in the secondary battery 30 brought about by the charging in the operation mode.

Further, an explanation is given above of an example configuration in which the supplemental charging is performed by switching between the first control and the second control only on a specific day of the week, or more specifically Friday, which is followed by a non-business day (non-working day) set in advance by the user (Saturday). However, the present invention is not limited in this way. For example, when Saturday and Sunday do not correspond to non-working days but rather, a day of the week other than Saturday and Sunday corresponds to a non-working day in the installation environment of the image forming device, such a day of the week may be set as a non-working day, and further, a day prior to such a day may be set as the specific day.

Furthermore, instead of a configuration where the user sets non-working days, a configuration may be adopted, for example, where governmental holidays (such as Saturdays, Sundays and national holidays) are set as non-working days in advance by the calendar function. Alternatively, any day during which the frequency of execution requests for image forming jobs being made is expected to be lower than or equal to that in the second time period, including non-business days, may be set as non-working days.

(8) Control of Charging of Secondary Battery 30

Figure 9:
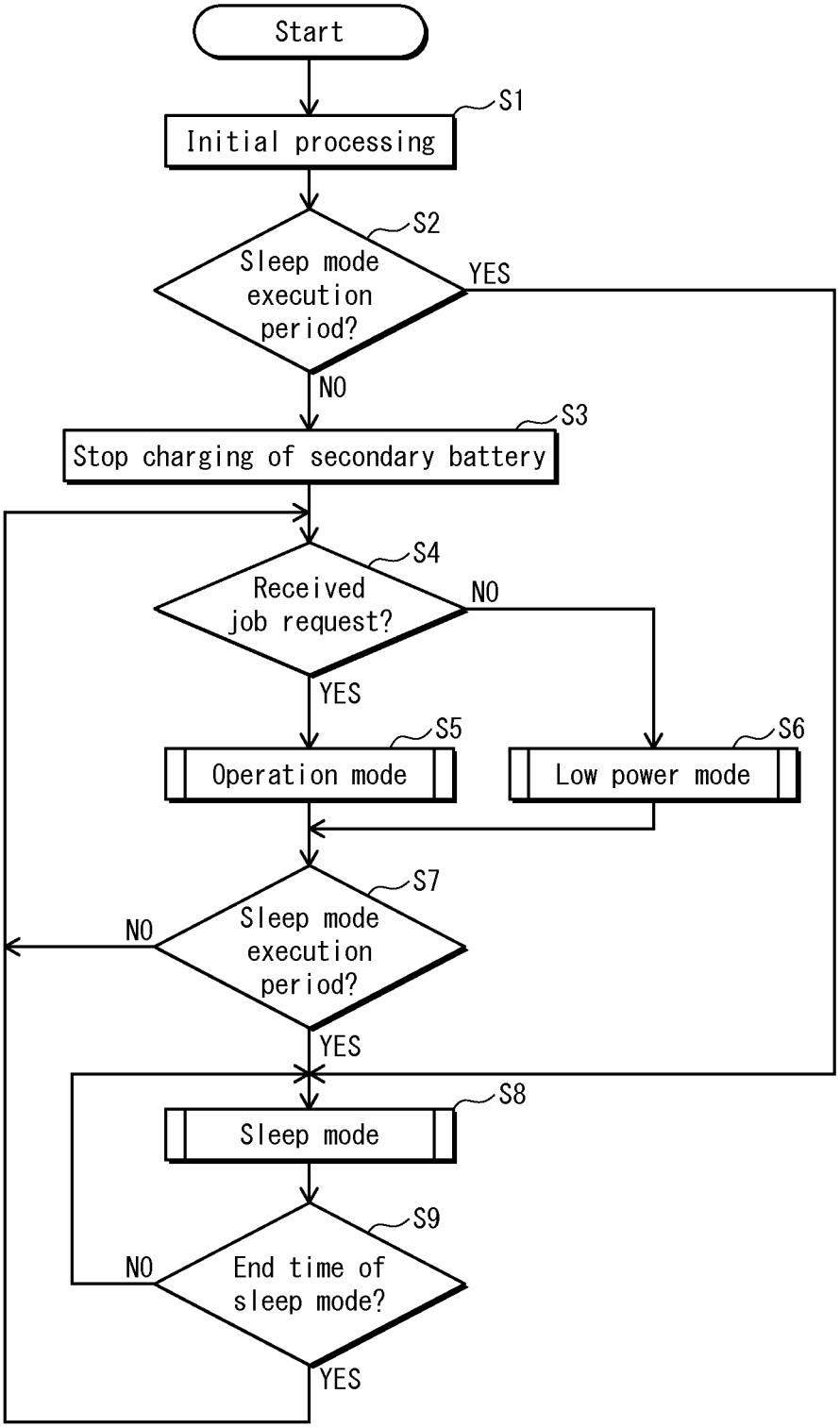
FIG. 9 is a flowchart illustrating details of a charging control of the secondary battery.

FIG. 9 is a flowchart illustrating details of a control of charging of the secondary battery 30. The control is performed by the power supply control unit 13.

As shown in FIG. 9, first, initial processing is performed (step S1). The initial processing is processing including initializing an internal memory of the power supply control unit 13 and resetting such elements as an internal timer of the power supply control unit 13.

Then, the power supply control unit 13 determines whether or not the current time is within a period of execution of the sleep mode (step S2). The current time is clocked by the clock IC 134. The sleep mode is executed between the start time and the end time, which are both set in advance, and the start time and the end time can be acquired by referring to the timing information stored in the storage unit 16.

In the example described above, the start time of the sleep mode is set to 6 p.m. and the end time of the sleep mode is set to 9 a.m. each day from Monday to Friday. Further, with regards to the period from Friday to Monday the following week, the start time of the sleep mode for the period is set to 6 p.m. on Friday, and the end time of the sleep mode for the period is set to 9 a.m. on Monday the following week. This is since, Saturday and Sunday, which are set as non-working days, exist between Friday and Monday the following week. The start time and the end time of the sleep mode for each day of the week as described above are included in the timing information.

Note that, when the user has selected non-execution of the sleep mode, the current time never falls within the period of execution of the sleep mode, and therefore, the power supply control unit 13 determines at all times that the current time is not within the period of execution of the sleep mode.

When determining that the current time is not within the period of execution of the sleep mode (at step S2, "NO"), the power supply control unit 13 puts the charge circuit 14 in a charge stopped state for stopping the charging of the secondary battery 30 (step S3). The power supply control unit 13 puts the charge circuit 14 in the charge stopped state by switching the switch 81 of the charge circuit 14 off, and stopping the operation of the voltage boost circuit 82. This processing is referred to as "stopping charging" of the secondary battery 30.

Next, the power supply control unit 13 determines whether or not an execution request for an image forming job (hereafter, "job request") has been received (step S4). This is determined depending on whether or not the execution request reception notification for an image forming job has been received from the device body 20.

When the power supply control unit 13 determines that a job request has been received (at step S4, "YES"), the operation mode is executed (step S5) and processing advances to step S7. On the other hand, when the power supply control unit 13 determines that a job request has not been received (at step S4, "NO"), the low power mode is executed (step S6) and processing advances to step S7.

(8-1 Operation Mode)

Figure 10:
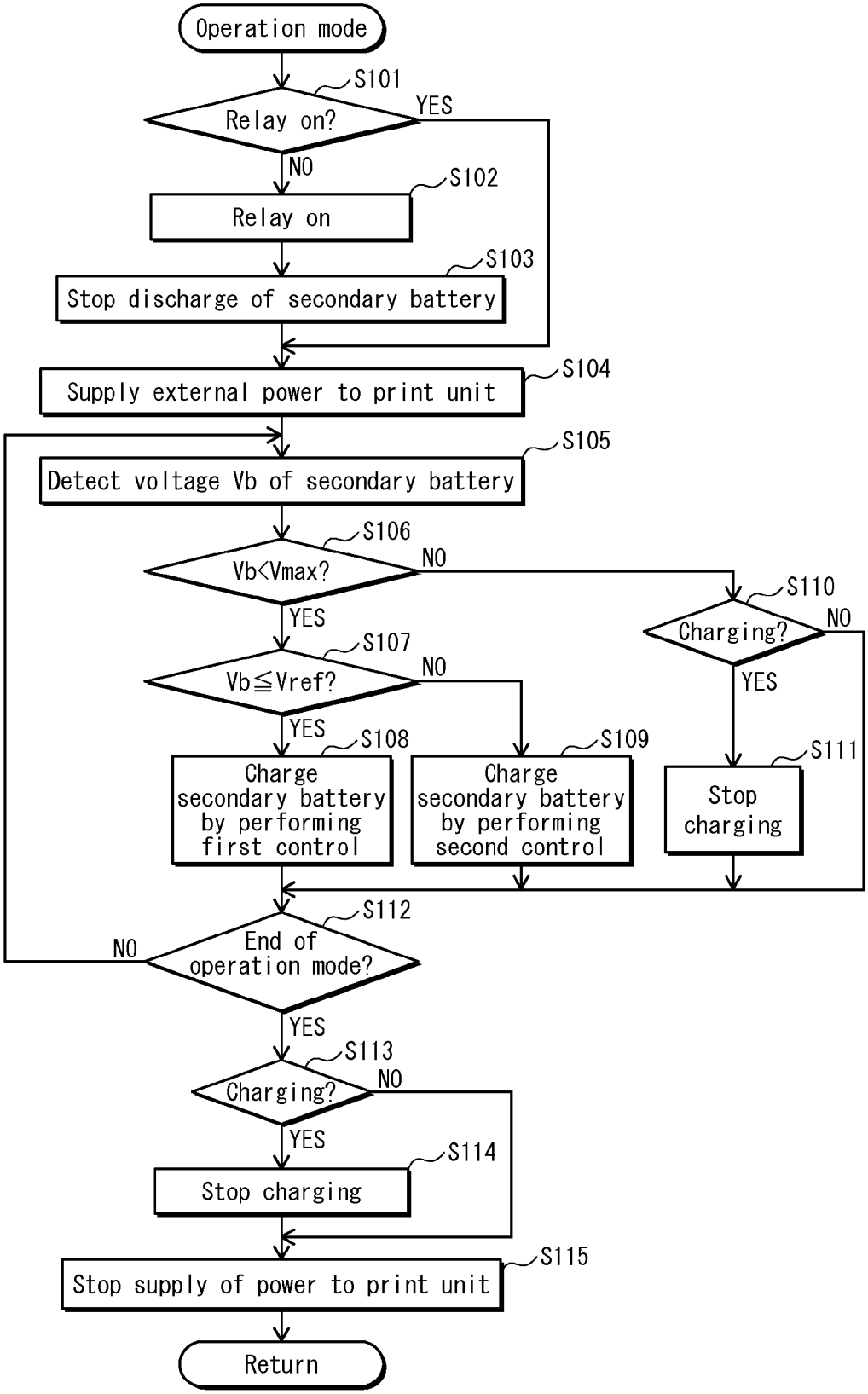
FIG. 10 is a flowchart illustrating details of a sub-routine in the execution of the operation mode.

FIG. 10 is a flowchart illustrating details of a subroutine of the operation mode.

As shown in FIG. 10, the power supply control unit 13 determines whether or not the relay 11 is on (step S101).

When determining that the relay 11 is not on (at step S101, "NO"), the power supply control unit 13 switches the relay 11 on (step S102), and then causes discharge of the secondary battery 30 to be stopped (step S103). Subsequently, processing advances to step S104. Specifically, the power supply control unit 13 causes the discharge control unit 15 to stop discharge of the secondary battery 30.

When the relay 11 is already on (at step S101, "YES"), step S102 and step S103 are skipped (not executed), and processing advances to step S104.

In step S104, the power supply control unit 13 causes the print unit 21 to enter a power supplied state, in which the print unit 21 is supplied the external power, in the form of the DC 24 V and the DC 5 V from the AC-DC power supply 12. Specifically, the power supply control unit 13 instructs the AC-DC power supply 12 to output the DC 24 V and causes the switch 17 to switch on.

Due to the relay 11 being on and the print unit 21 being in the power supplied state, the print unit 21 is supplied the DC 24 V and the DC 5 V from the AC-DC power supply 12. Accordingly, the print unit 21 enters a state in which execution of an image forming job that is received is possible, and upon reception of job data of the image forming job from the I/F unit 22, executes the image forming job.

Further, when the relay 11 is on, the I/F unit 22 is supplied the DC 5 V from the AC-DC power supply 12. Accordingly, the I/F unit 22 enters a state in which reception of a new image forming job is possible. Note that the charge circuit 14 is also supplied the DC 5 V from the AC-DC power supply 12, but since the charge circuit 14 has been put in the charge stopped state at step S3, charging of the secondary battery 30 is not performed at this point in processing.

While the image forming job is being executed at the print unit 21, the power supply control unit 13 detects the voltage Vb of the secondary battery 30 at the current time (step S105). The battery voltage detection unit 133 is responsible for detection of the voltage Vb of the secondary battery 30.

The power supply control unit 13 determines whether or not the voltage Vb so detected is lower than the full charge voltage Vmax (step S106). When determining Vb<Vmax (at step S106, "YES"), the power supply control unit 13 determines whether or not the voltage Vb is equal to or lower than the threshold voltage Vref, which is a condition for switching between the first control and the second control (step S107).

For example, when determining Vb≤Vref (at step S107, "YES"), the power supply control unit 13 performs charging of the secondary battery 30 by using the first control (step S108). Subsequently, processing advances to step S112. The charging in step S108 corresponds to the charging in the first section, when the amount of energy in the secondary battery 30 is between 0 and 80%, as shown in FIG. 4.

In step S112, the power supply control unit 13 determines whether or not the operation mode is to be ended, based on whether or not the job completion notification has been received from the device body 20.

When the power supply control unit 13 determines that the operation mode is not to be ended, i.e. an image forming job is being executed (at step S112, "NO"), processing returns to step S105 and processing in step S105 and on is executed.

For example, when determining Vb<Vmax (at step S106, "YES"), and also determining that Vb≤Vref is still satisfied (at step S107 "YES"), the power supply control unit 13 continues charging the secondary battery 30 by using the first control (step S108).

On the other hand, when determining Vb<Vmax (at step S106, "YES"), but also determining Vb>Vref (at step S107 "NO"), the power supply control unit 13 performs charging of the secondary battery 30 by using the second control instead of the first control (step S109). Subsequently, processing advances to step S112. The charging in step S109 corresponds to the charging in the second interval, when the amount of energy in the secondary battery 30 is between 80 and 100%, as shown in FIG. 4.

When the power supply control unit 13 determines that the operation mode is not to be ended (at step S112, "NO"), processing returns to step S105 once again and processing in step S105 and on is repeatedly performed.

For example, when Vb<Vmax (at step S106, "YES"), and Vb>Vref is still satisfied (at step S107 "NO"), charging of the secondary battery 30 by using the second control is continued (step S109).

In contrast, when Vb≥Vmax (at step 106, "NO"), and if the secondary battery 30 is currently being charged (at step S110, "YES"), the power supply control unit 13 stops charging of the secondary battery 30 (step S111). Subsequently, processing advances to step S112. On the other hand, when the secondary battery 30 is not currently being charged (at step S110, "NO"), step S111 is skipped and processing advances to step S112. In other words, when Vb≥Vmax, the charging of the secondary battery 30 is stopped.

Until the power supply control unit 13 determines that the operation mode is to be ended at step S112, processing in step S105 and on is repeated.

For example, when Vb<Vref at the start of charging, the power supply control unit 13 performs charging of the secondary battery 30 by using the first control until the voltage Vb reaches the threshold voltage Vref (the first interval), and performs charging of the secondary battery 30 by using the second control until the full charge voltage Vmax is reached, after the voltage Vb exceeds the threshold voltage Vref (the second interval).

When determining that the operation mode is to be ended (at step S112, "YES"), and the secondary battery 30 is currently being charged (at step S113, "YES"), the power supply control unit 13 stops charging of the secondary battery 30 (step S114). Subsequently, processing advances to step S115. On the other hand, when the secondary battery 30 is not currently being charged (at step S113, "NO"), step S114 is skipped and processing advances to step S115.

In step S115, the power supply control unit 13 puts the print unit 21 in a state in which supply of power to the print unit 21 is stopped. The power supply control unit 13 puts the print unit 21 in the state in which power supply is stopped by instructing the AC-DC power supply 12 to stop the output of the DC 24 V and switching the switch 17 off. Thus, supply of the DC 24 V and the DC 5 V from the AC-DC power supply 12 to the print unit 21 is stopped. After the processing in step S115 is executed, processing returns.

In FIG. 9, in step S7, the power supply control unit 13 determines whether or not the current time is within the period of execution of the sleep mode (the second time period), by the same method as in step S2.

When the power supply control unit 13 determines that the current time is not within the period of execution of the sleep mode (at step S7, "NO"), i.e. the current time is within the first period (as described above, the period from 9 a.m. until 6 p.m.), processing returns to step S4. When the power supply control unit 13 determines that a new job request has not been received (at step S4, "NO"), the power supply control unit 13 executes the low power mode (step S6).

(8-2) Low Power Mode

Figure 11:
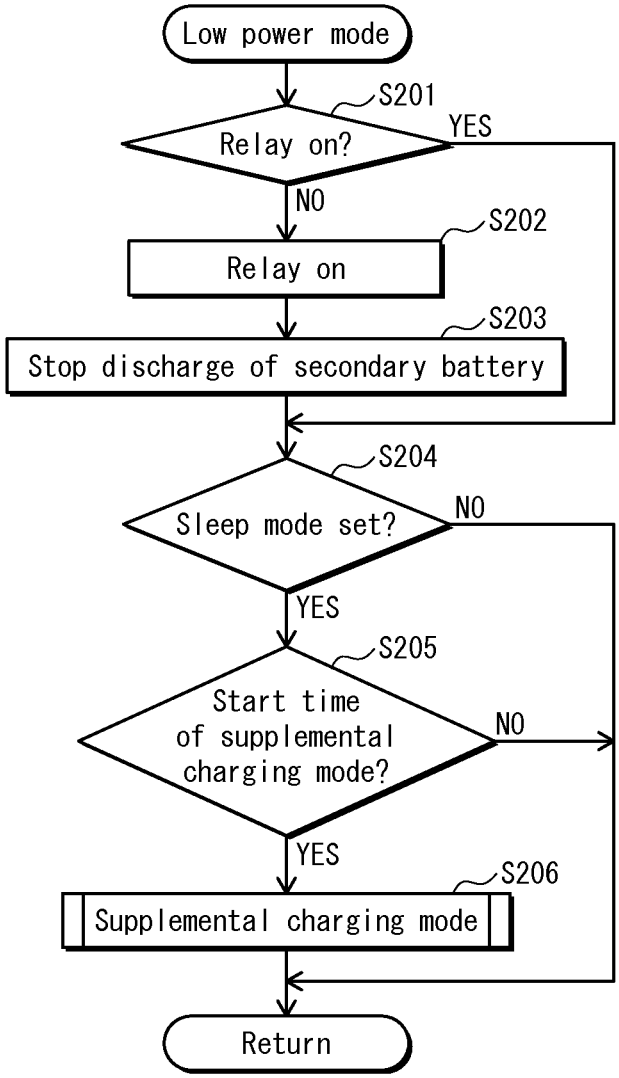
FIG. 11 is a flowchart illustrating details of a sub-routine in the execution of the low power mode.

FIG. 11 is a flowchart illustrating details of a subroutine of the low power mode.

As shown in FIG. 11, the power supply control unit 13 determines whether or not the relay 11 is on (step S201).

When determining that the relay 11 is not on (at step S201, "NO"), the power supply control unit 13 switches the relay 11 on (step S202), and then causes the discharge control unit 15 to stop discharge of the secondary battery 30 (step S203). Subsequently, processing advances to step S204.

When the relay 11 is already on (at step S201, "YES"), step S202 and step S203 are skipped, and processing advances to step S204.

In step S204, the power supply control unit 13 determines whether or not the sleep mode is set.

When the power supply control unit 13 determines that the sleep mode is not set (at step S204, "NO"), processing returns. In this case, processing then advances to step S7 in FIG. 9. Here it should be noted that when the sleep mode is not set, the power supply control unit 13 always determines "NO" at step S7, and processing returns to step S4. Further, unless a job request is received (at step S4, "NO"), processing returns to step S6 once again.

When the sleep mode is not set, and unless a job request is received, the power supply control unit 13 continues the execution of the low power mode. Upon the reception of a job request, the power supply control unit 13 switches to executing the operation mode, and an image forming job is executed based on the job request. When the image forming job is completed, the power supply control unit 13 returns to executing the low power mode once again. The switching between the low power mode and the operation mode, as described above, is repeatedly performed when the sleep mode is not set.

Returning to FIG. 11, when determining that the sleep mode is set (at step S204, "YES"), the power supply control unit 13 determines whether or not the current time has reached the start time of the supplemental charging mode, which in the example described above is 5 p.m. (step S205). Note that herein, when the start time of the supplemental charging mode is reached, the current time is within the specific interval, i.e. between the start time and the end time (6 p.m.) of the supplemental charging mode.

When the power supply control unit 13 determines that the current time has not reached the start time of the supplemental charging mode (at step S205, "NO"), processing returns.

In this case, processing advances to step S7, in FIG. 9, and even when the sleep mode is set, if the current time is not within the period of execution of the sleep mode (at step S7, "NO"), processing returns to step S4. Further, when a job request is not received (at step S4, "NO"), processing advances to step S6 once again (i.e., the low power mode).

When the image forming device returns to executing the low power mode, processing in step S205 is executed once again. When it is determined that the start time of the supplemental charging mode is not yet reached (at step S205, "NO"), processing returns.

Until the current time reaches the start time of the supplemental charging mode, in each iteration of the routine, a determination of "YES" is made in step S204, and a determination of "NO" is made in step S205, and unless a job request is received, the power supply control unit 13 continues the execution of the low power mode.

On the other hand, when determining that the start time of the supplemental charging mode is reached (at step S205, "YES"), the power supply control unit 13 executes the supplemental charging mode (step S206). Subsequently, processing returns.

(8-3) Supplemental Charging Mode

Figure 12:
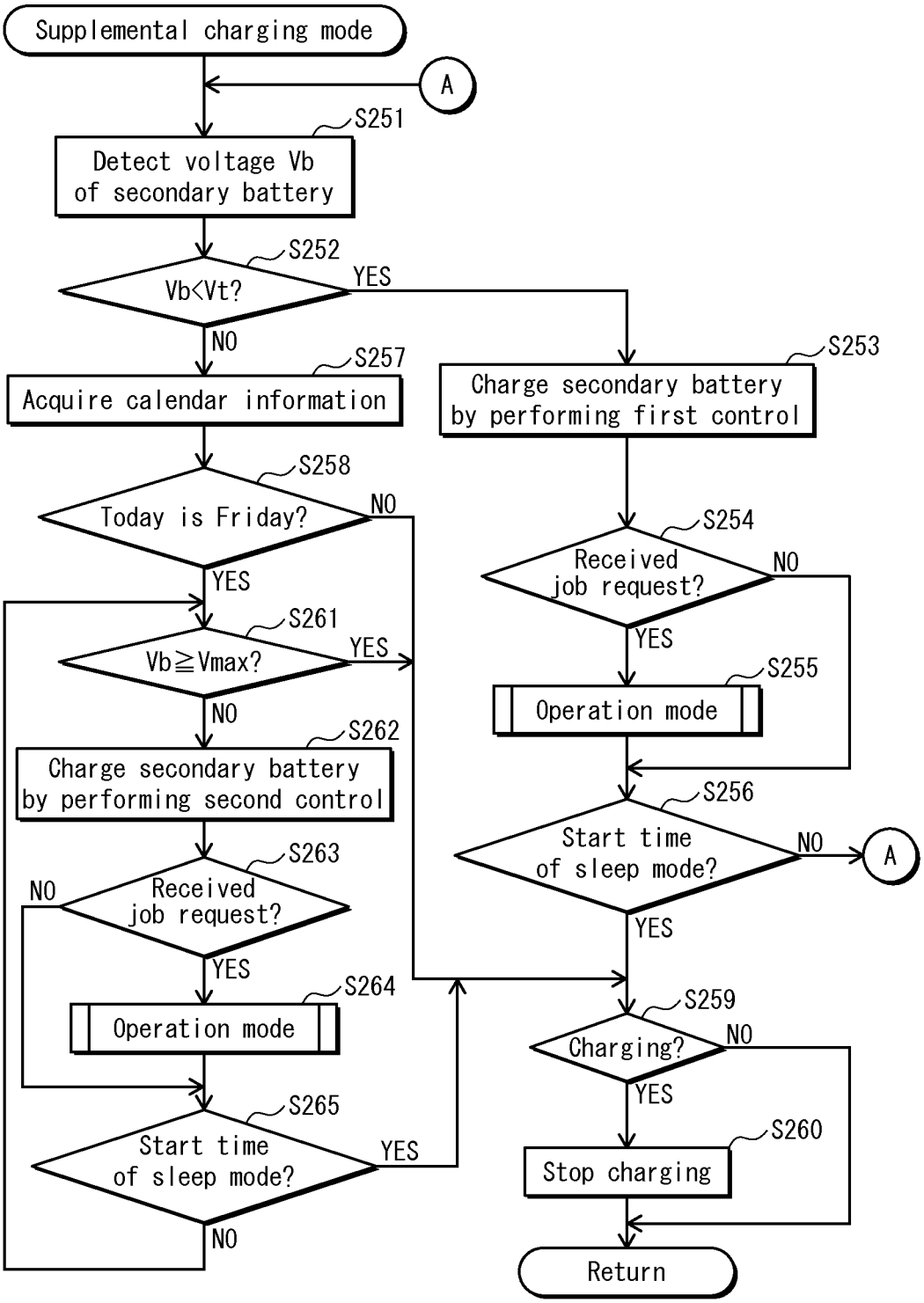
FIG. 12 is a flowchart illustrating details of a sub-routine in the execution of the supplemental charging mode.

FIG. 12 is a flowchart illustrating details of a subroutine of the supplemental charging mode.

As shown in FIG. 12, the power supply control unit 13 detects the voltage Vb of the secondary battery 30 (step S251). The power supply control unit 13 then determines whether or not the detected voltage Vb is lower than the target voltage Vt (step S252).

When determining Vb<Vt (at step S252, "YES"), the power supply control unit 13 performs charging of the secondary battery 30 by using the first control (step S253).

While the secondary battery 30 is being charged, the power supply control unit 13 determines whether or not a job request is received (step S254). When determining that a job request is received (at step S254, "YES"), the power supply control unit 13 switches to executing the operation mode (step S255). Here, processing in the operation mode is the same as described above in step S5. When the operation mode ends, processing advances to step S256.

On the other hand, when the power supply control unit 13 determines that a job request is not received (at step S254, "NO"), step S255 is skipped and processing advances to step S256.

In step S256, the power supply control unit 13 determines whether or not the current time has reached the start time of the sleep mode.

When the power supply control unit 13 determines that the current time has not reached the start time of the sleep mode (at step S256, "NO"), processing returns to step S251, and processing in step S251 and on is executed.

When once again determining Vb<Vt (at step S252, "YES"), the power supply control unit 13 performs charging of the secondary battery 30 by using the first control (step S253). Further, unless the start time of the sleep mode is reached (at step S256, "NO"), processing returns to step S251.

When Vb≥Vt is satisfied due to the charging of the secondary battery 30 before the start time of the sleep mode (at step S252, "NO"), the power supply control unit 13 acquires the calendar information (step S257). The calendar information is read from the clock IC 134.

Then, referencing the acquired calendar information, the power supply control unit 13 determines whether or not the current day is a Friday (step S258).

When determining that the current day is not a Friday, i.e., that the current day is any day from Monday to Thursday (at step S258, "NO"), the power supply control unit 13 determines whether or not the secondary battery 30 is currently being charged (step S259). When the secondary battery 30 is currently being charged (at step S259, "YES"), the power supply control unit 13 stops charging of the secondary battery 30 (step S260). Subsequently, processing returns. When the secondary battery 30 is not currently being charged (at step S259, "NO"), step S260 is skipped and processing returns.

From Monday to Thursday, since it suffices that the voltage Vb of the secondary battery 30 is increased to the target voltage Vt by the supplemental charging performed immediately before entering the sleep mode, processing returns without the secondary battery 30 being fully charged.

On the other hand, when determining that the current day is a Friday (at step S258, "YES"), the power supply control unit 13 determines whether or not the voltage Vb of the secondary battery 30 is equal to or greater than the full charge voltage Vmax (step S261).

When determining Vb<Vmax (at step S261, "NO"), the power supply control unit 13 performs charging of the secondary battery 30 by using the second control (step S262). Here, when the power supply control unit 13 has been performing charging of the secondary battery 30 by using the first control, the power supply control unit 13 switches from the first control to the second control.

While the secondary battery 30 is being charged, the power supply control unit 13 determines whether or not a job request is received (step S263). When determining that a job request is received (at step S263, "YES"), the power supply control unit 13 switches to executing the operation mode (step S264). Here, processing in the operation mode is the same as described above in step S5. When the operation mode ends, processing advances to step S265.

On the other hand, when the power supply control unit 13 determines that a job request is not received (at step S263, "NO"), step S264 is skipped, and processing advances to step S265.

In step S265, the power supply control unit 13 determines whether or not the start time of the sleep mode has been reached.

When the power supply control unit 13 determines that the start time of the sleep mode has not been reached (at step S265, "NO"), processing returns to step S261, and processing in step S261 and on is executed.

When determining Vb<Vmax once again (at step S261, "NO"), the power supply control unit 13 performs charging of the secondary battery 30 by using the second control (step S262). Further, unless the start time of the sleep mode is reached (at step S265, "NO"), processing returns to step S261. When Vb≥Vmax is satisfied due to the charging of the secondary battery 30 before the start time of the sleep mode is reached (at step S261, "YES"), processing advances to step S259.

When that the secondary battery 30 is currently being charged (at step S259, "YES"), after the power supply control unit 13 stops charging of the secondary battery 30 (step S260), processing returns. When the secondary battery 30 is not currently being charged, step S260 is skipped and processing returns.

The processing described above is performed on Friday, which is a day before a non-working day. As such, the secondary battery 30 is fully charged by the supplemental charging performed immediately before entering the sleep mode.

Further, when the start time of the sleep mode is reached before Vb≥Vmax is satisfied (at step S265, "YES"), processing advances to steps S259 and S260 and the power supply control unit 13 stops charging of the secondary battery 30. Subsequently, processing returns.

In the same way, in steps S252 through S256, when the start time of the sleep mode is reached before Vb≥Vt is satisfied (at step S256, "YES"), processing advances to steps S259 and S260 and the power supply control unit 13 stops charging of the secondary battery 30. Subsequently, processing returns.

Unless an image forming job is currently being executed, the power supply control unit 13 switches to executing the sleep mode when the start time of the sleep mode is reached. Note that here, even when charging of the secondary battery 30 is currently being performed, the power supply control unit 13 stops charging of the secondary battery 30 and switches to executing the sleep mode. Further, when an image forming job is currently being executed, the power supply control unit 13 switches to executing the sleep mode after the image forming job is completed.

Note that the supplemental charging is executed within a given day from the time Ta (5 p.m.), which belongs to the first time period, until the start time of the second time period (6 p.m.). Further, the supplemental charging is performed, within the above described period, when the image forming device is in the low power mode, and the voltage Vb of the secondary battery 30 is lower than the target voltage Vt. Accordingly, even when such conditions for executing the supplemental charging are not met at the time Ta, supplemental charging may be executed when such conditions are met at a point after the time Ta and before the start time of the second time period.

Returning to FIG. 9, when determining that the current time is within the period of execution of the sleep mode (at step S7, "YES"), the power supply control unit 13 executes the sleep mode (step S8). Thus, switching from the operation mode and the low power mode to the sleep mode is performed. Also, in step S2, when determining that the current time is within the period of execution of the sleep mode (at step S2, "YES"), the power supply control unit 13 executes the sleep mode (step S8).

(8-4) Sleep Mode

Figure 13:
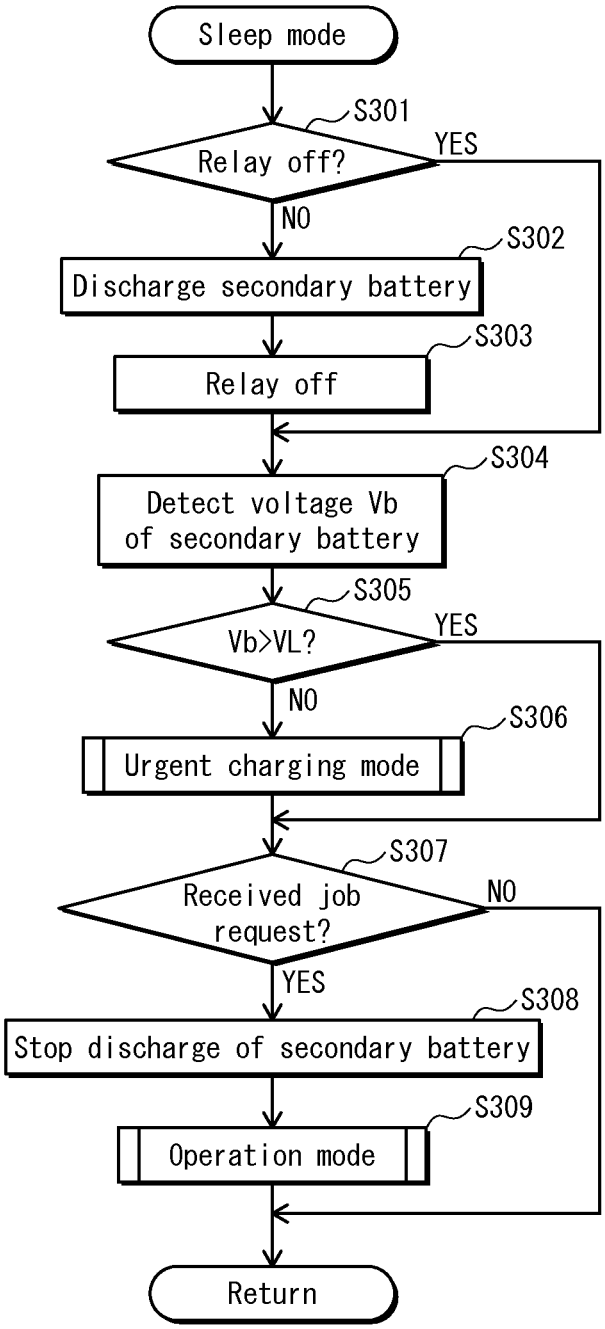
FIG. 13 is a flowchart illustrating details of a sub-routine in the execution of the sleep mode.

FIG. 13 is a flowchart illustrating details of a subroutine of the sleep mode.

As shown in FIG. 13, the power supply control unit 13 determines whether or not the relay 11 is off (step S301).

When determining that the relay 11 is not off (at step S301, "NO"), the power supply control unit 13 puts the secondary battery 30 in a discharge state (step S302), and switches the relay 11 off (step S303). Subsequently, processing advances to step S304. Specifically, the discharge control unit 15 causes the secondary battery 30 to discharge.

When the relay 11 is switched off and the secondary battery 30 is put in the discharge state, power from the secondary battery 30 is supplied to the power supply control unit 13 and the I/F unit 22. Note that the power supply control unit 13 and the I/F unit 22 are able to operate by using power from the secondary battery 30 even when the relay 11 is off.

When the relay 11 is already off (at step S301, "YES"), steps S302 and S303 are skipped, and processing advances to step S304. In the present embodiment, the secondary battery 30 is put in the discharge state immediately before the relay 11 is switched off (steps S302 and S303). Therefore, when the relay 11 is determined as being off, the secondary battery 30 is already in the discharge state, and even if step S302 is skipped, the discharge of the secondary battery 30 continues.

In step S304, the power supply control unit 13 detects the current voltage Vb of the secondary battery 30. Then, the power supply control unit 13 determines whether or not the detected voltage Vb is higher than the lower limit voltage VL (step S305).

When the power supply control unit 13 determines Vb>VL (step S305, "YES"), processing advances to step S307.

In step S307, the power supply control unit 13 determines whether or not a job request is received. When the power supply control unit 13 determines that a job request is not received (at step S307, "NO"), processing returns.

Returning to FIG. 9, in step S9, the power supply control unit 13 determines whether or not the end time of the sleep mode has been reached (in the above example, 9 a.m. the following day).

When the power supply control unit 13 determines that the end time of the sleep mode has not been reached (at step S9, "NO"), processing returns to step S8 and the execution of the sleep mode continues.

In this case, processing in step S301 and on in FIG. 13 is repeatedly performed.

In step S301, when the power supply control unit 13 determines that the relay 11 is off, steps S302 and S303 are skipped. Subsequently, when determining that the voltage Vb is higher than the lower limit voltage VL at step S305, the power supply control unit 13 determines whether or not a job request is received at step S307.

When the power supply control unit 13 determines that a job request is not received (at step S307, "NO"), processing returns. Subsequently, unless the end time of the sleep mode is reached, processing in step S301 and on is executed once again.

Until the end time of the sleep mode is reached, processing in step S301 and on is repeatedly performed, and discharge of the secondary battery 30 is continued. Accordingly, the I/F unit 22 operates by using power from the secondary battery 30 and is able to receive job requests from an external terminal or the like.

When determining that a job request is received during the execution of the sleep mode (at step S307, "YES"), the power supply control unit 13 causes the secondary battery 30 to stop discharging (step S308), and then temporarily switches to executing the operation mode (step S309). Here, processing in the operation mode is the same as described above in step S5. When the operation mode ends, unless the end time of the sleep mode is reached, the power supply control unit 13 again returns to executing the sleep mode. Further, processing in step S301 and on is executed, such as switching the relay 11 off and starting discharge of the secondary battery 30.

During the sleep mode, when the amount of energy discharged from the secondary battery 30 increases to a point where Vb>VL is no longer satisfied, i.e. when the power supply control unit 13 determines that Vb≤VL is satisfied (at step S305, "NO"), the urgent charging mode is executed (step S306).

(8-5) Urgent Charging Mode

Figure 14:
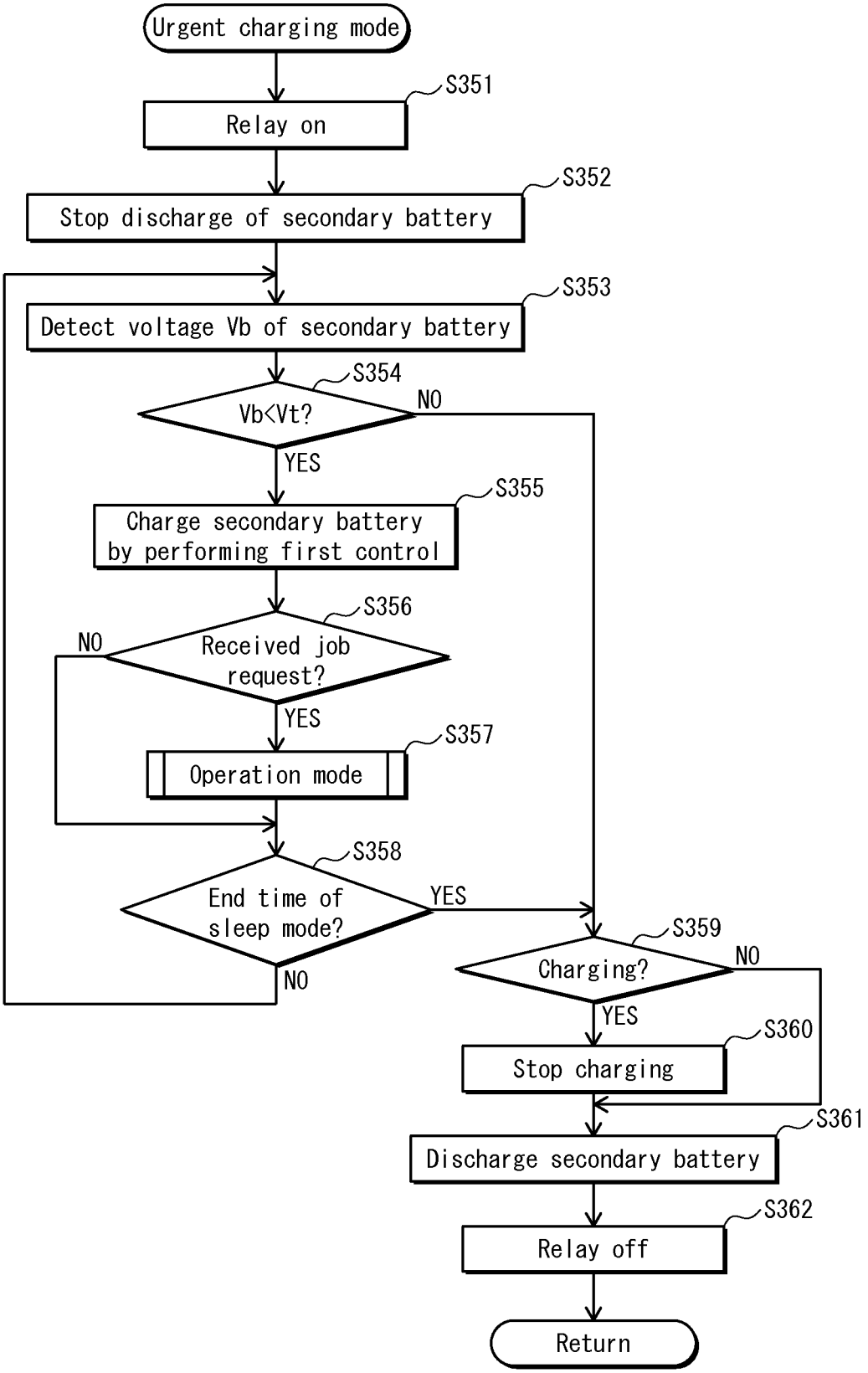
FIG. 14 is a flowchart illustrating details of a sub-routine in the execution of the urgent charging mode.

FIG. 14 is a flowchart illustrating details of a subroutine of the urgent charging mode.

As shown in FIG. 14, the power supply control unit 13 switches the relay 11 on (step S351), and causes the secondary battery 30 to stop discharging (step S352). By switching the relay 11 on, the DC 5 V from the AC-DC power supply 12 is supplied to the I/F unit 22. As such, the I/F unit 22 operates by using the DC 5 V from the AC-DC power supply 12 as a drive source and is able to receive a job request of an image forming job from an external terminal even when the discharge of the secondary battery 30 is stopped.

Next, the power supply control unit 13 detects the current voltage Vb of the secondary battery 30 (step S353), and determines whether or not the detected voltage Vb is lower than the target voltage Vt (step S354).

When determining Vb<Vt (at step S354, "YES"), the power supply control unit 13 performs charging of the secondary battery 30 by using the first control (step S355).

While the secondary battery 30 is currently being charged, the power supply control unit 13 determines whether or not a job request is received (step S356). When determining that a job request is received (at step S356, "YES"), the power supply control unit 13 switches to executing the operation mode (step S357). Here, processing in the operation mode is the same as described above in step S5. When the operation mode ends, processing advances to step S358.

On the other hand, when the power supply control unit 13 determines that a job request is not received (at step S356, "NO"), step S357 is skipped, and processing advances to step S358.

In step S358, the power supply control unit 13 determines whether or not the end time of the sleep mode (in the above example, 9 a.m. the following day) is reached.

When the power supply control unit 13 determines that the end time of the sleep mode is not reached (at step S358, "NO"), processing returns to step S353 and processing in step S353 and on is repeatedly performed.

When determining Vb<Vt once again (at step S354, "YES"), the power supply control unit 13 continues charging the secondary battery 30 by using the first control (step S355). Unless the end time of the sleep mode is reached (at step S358, "NO"), processing returns to step S353.

When Vb≥Vt is satisfied due to charging of the secondary battery 30 before reaching the end time of the sleep mode (at step S354, "NO"), the power supply control unit determines whether or not the secondary battery is currently being charged. When the secondary battery 30 is currently being charged (at step S359, "YES"), the power supply control unit 13 stops charging of the secondary battery 30 (step S360), and processing advances to step S361. On the other hand, when the power supply control unit 13 determines that the secondary battery 30 is not currently being charged (at step S359, "NO"), step S360 is skipped and processing advances to step S361. Thus, when Vb≥Vt is satisfied, the power supply control unit 13 stops charging of the secondary battery 30.

Note that, during the charging of the secondary battery 30, when the end time of the sleep mode is reached before Vb≥Vt is satisfied (at step S358, "YES"), the processing in steps S359 and S360 is executed, whereby the charging of the secondary battery 30 is stopped.

When the secondary battery 30 is not currently being charged, after putting the secondary battery 30 in the discharge state (step S361), the power supply control unit 13 switches the relay 11 off (step S362). Subsequently, processing returns to step S306 and advances to the next step. Thus, the urgent charging is ended and the image forming device is again returned to the sleep mode.

Upon returning to the sleep mode, the voltage Vb of the secondary battery 30 is equal to or higher than the lower limit voltage VL. Therefore, the I/F unit 22 operates by using power from the secondary battery 30 and is able to receive a job request of an image forming job from an external terminal.

In FIG. 9, when the power supply control unit 13 determines that the end time of the sleep mode has been reached (at step S9, "YES"), processing returns to step S4.

When the power supply control unit 13 determines that a job request is received (at step S4, "YES"), the operation mode is executed (step S5). When determining that a job request is not received (at step S4, "NO"), the power supply control unit 13 executes the low power mode (step S6). Thus, switching from the sleep mode to the operation mode or the low power mode is executed. Following this point, processing in steps S4 to S9 is repeatedly performed.

As explained above, in the present embodiment, the secondary battery 30 is charged by performing the first control, in which the voltage boost circuit 82 is not used, until the voltage of the secondary battery 30 reaches the threshold voltage Vref. Further, from the threshold voltage Vref until the voltage of the secondary battery 30 reaches the full charge voltage Vmax, the secondary battery 30 is charged by switching to the second control, in which the voltage boost circuit 82 is used.

Thus, when compared to a configuration in which the secondary battery 30 is charged by performing the second control from when the charging of the secondary battery 30 is started until when the secondary battery 30 is fully charged, voltage conversion loss resulting from the boosting of voltage by the voltage boost circuit 82 is decreased.

Further, if the voltage boost circuit 82 were used from when the charging of the secondary battery 30 is started, the lower the voltage of the secondary battery 30, the greater the difference ΔV would be between the input voltage and the output voltage of the constant current circuit 83. Accordingly, the power loss across the constant current circuit 83 would increase correspondingly.

In comparison, in the present embodiment, the voltage boost circuit 82 is not used when the voltage of the secondary battery 30 is lower than the threshold voltage Vref at the point when the charging of the secondary battery 30 is started. Therefore, compared to when boosting of voltage is performed from when the charging of the secondary battery 30 is started, the difference ΔV between the input voltage and the output voltage of the constant current circuit 83 is reduced, and the power loss across the constant current circuit 83 is correspondingly smaller.

Comparing the configuration pertaining to the present embodiment, in which switching between the first control and the second control is performed, to a configuration where only the second control is used, the power loss across the voltage boost circuit 82 and the constant current circuit 83 occurring during the charging of the secondary battery 30 is smaller, and the efficiency of the charging of the secondary battery 30 is increased.

Here, note that the present invention is not limited to an image forming device, but may be a charging method of a secondary battery that is installed in an image forming device. Further, the present invention may be a program causing a computer to execute the charging method pertaining to the present invention. The program pertaining to the present invention may be recorded on various types of computer readable recording media: including magnetic disks such as magnetic tape and a flexible disk; optical recording media such as a DVD-ROM, a DVD-RAM, a CD-ROM, a CD-R, an MO, and a PD; and flash memory type recording media. Further, the program pertaining to the present invention may be produced, transferred, etc., in the form of recording media having the program recorded thereon, or may be transmitted and supplied in the form of a program via various types of wired or wireless network including the Internet, broadcasting, telecommunication lines, satellite communications, etc.

<Modifications>

Explanation is given above based on an embodiment of the present invention. However, the present invention is not limited to the above embodiment, and modifications as described below may be made.

(1) In the above embodiment, the condition for switching the image forming device to the sleep mode is that the start time of the sleep mode, set in advance by the user, is reached. However, the present invention is not limited in this way.

The condition for switching the image forming device to the sleep mode may be, for example, that during the low power mode, a predetermined period of time passes without a job request being received. In this case, a configuration may be made such that reception of a job request is the condition for ending the sleep mode and switching to the operation mode. When making such a modification, switching between modes is repeated such that the image forming device switches to the low power mode when the operation mode ends, and when a predetermined period of time passes without a job request being received during the low power mode, the image forming device switches to the sleep mode.

Also, the condition for switching the image forming device to the sleep mode may be, for example, (i) that a predetermined period of time passes during the low power mode without any instructions being made from the user via the operator input unit 35, or (ii) that an instruction to switch the image forming device to the sleep mode is received from the user. In this case, a configuration may be made such that, reception of any kind of instruction from the user, or reception of an instruction to end the sleep mode from the user is the condition for ending the sleep mode. Alternatively, the condition for switching to the sleep mode may be one or more of the above-described conditions, and the condition for ending the sleep mode may be one or more of the above-described conditions.

(2) In the above embodiment, explanation is given of an example configuration in which (i) the unit period (one day), is divided into the first time period and the second time period, (ii) switching between the operation mode (the second mode) and the low power mode (the third mode) is performed during the first time period, and (iii) switching between the sleep mode (the first mode) and the operation mode (the second mode) is performed during the second time period. However, the present invention is not limited in this way.

For example, in the first time period, the low power mode may be replaced with the sleep mode. When adopting this configuration, the image forming device is in the sleep mode (in a standby state) during periods of a day other than periods where the image forming device is in the operation mode (in operation state).

Figure 15:
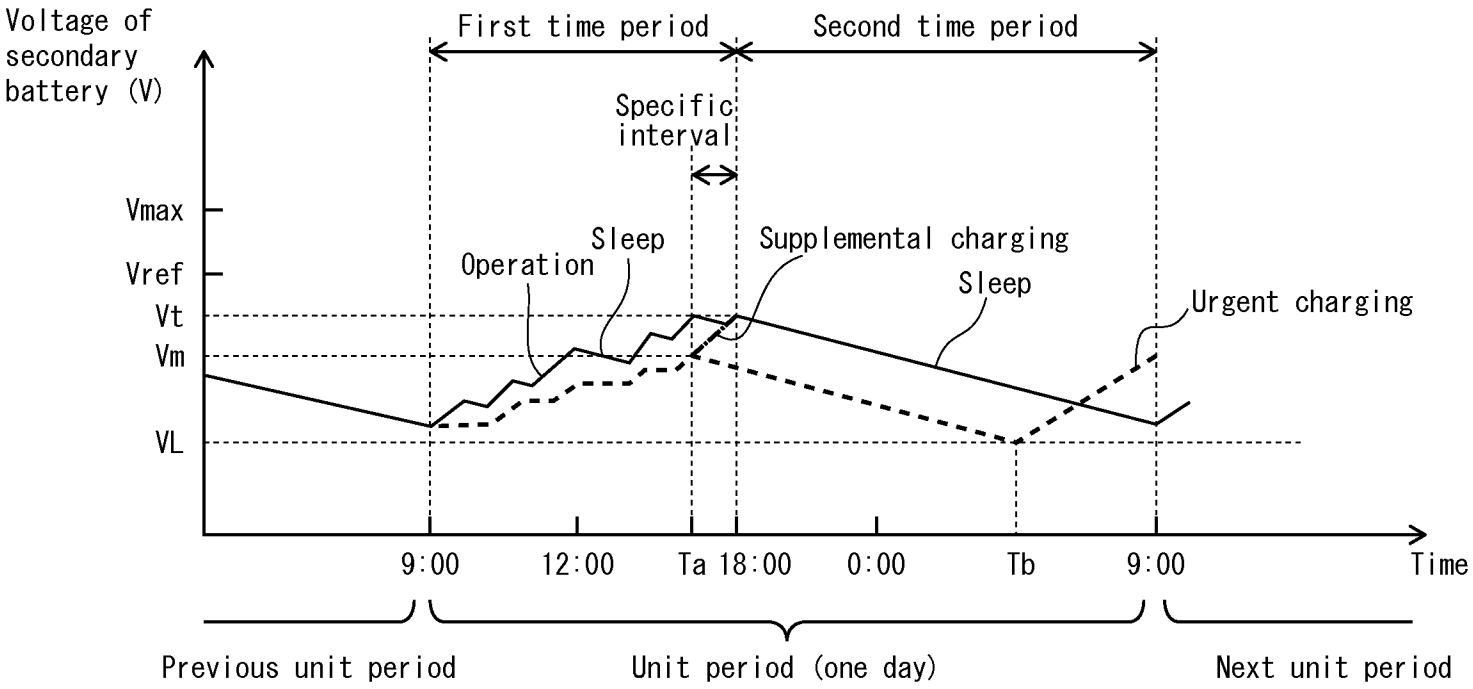
FIG. 15 is a diagram for explaining conditions of executing the supplemental charging mode and the urgent charging mode, in a modification.

FIG. 15 is a diagram for explaining conditions of executing the supplemental charging mode and the urgent charging mode when the above-described modification of replacing the low power mode with the sleep mode in the first time period is made.

As shown in FIG. 15, when making such a modification, even in the first time period, the image forming device switches to the sleep mode during periods other than periods during which the image forming device job is in the operation mode and executing an image forming job. Further, in this case, the specific interval for supplemental charging is the period from the time Ta (5 p.m.) in the first time period until the start time of the second time period (6 p.m.). In addition, the supplemental charging is performed when, within the specific interval, the voltage Vb of the secondary battery 30 is lower than the target voltage Vt and the image forming device is in the sleep mode. In a configuration where the low power mode is not executed, as in the present modification, the switch 17 is not necessary, and further, the control of switching between outputting and stopping the DC 24 V output from the AC-DC power supply 12 is not necessary. When making such a modification, consumption of the external power can be reduced by not using the low power mode.

Also, a modification may be made such that the second time period is not set within the unit period, or that is, a day (the unit period) is composed of only the first time period. When making such a modification, the operation mode and the sleep mode are alternately executed throughout the day.

Further, even when making such a modification, the specific interval for supplemental charging may be set when it is expected that the frequency of execution of image forming jobs is low at certain periods within a day. Such periods may be immediately before the end of business hours (e.g. 6 p.m.) or a period of several hours around midday, and in such cases, the specific interval may be set to a period immediately before such periods.

Furthermore, in the above embodiment, explanation is given of executing the supplemental charging mode immediately before the start of the sleep mode. However, the present invention is not limited in this way. For example, a modification may be made such that the supplemental charging mode is not executed whereas the sleep mode is executed. In addition, a modification may be made such that the user is able to perform input with respect to the operator input unit 53, etc., and thereby make a selection of the mode of the image forming device.

Also, in the above embodiment, explanation is given of dividing the unit period into the first time period and the second time period. However, the present invention is not limited in this way. For example, a modification may be made such that, in the unit period, the first time period and the second time period are each included multiple times in alternation. Furthermore, although the unit period is described as having a duration of one day, the unit period may have a different duration, such as a duration of 12 hours.

(3) In the above embodiment, the execution time of the operation mode is described as being a period from the reception of a job request until the image forming job of the job request is completed. However, the present invention is not limited in this way. For example, the execution time of the operation mode may be a period from the reception of a job request until a predetermined time passes after the image forming job of the job request is completed. When making such a modification, the external power is supplied to the print unit 21 until the predetermined time elapses from the completion of the image forming job. Thus, when a next image forming job is received before the elapse of the predetermined time, execution of the next image forming job can be started immediately since the external power is being supplied to the print unit 21.

In particular, this modification is effective when applied to a configuration where time is required to increase a temperature of a fixing unit included in the print unit 21 to a fixing temperature by performing warm-up.

Specifically, during the low power mode, due to power not being supplied to the print unit 21, the fixing unit is in a low temperature state. When a new job request is received while the fixing unit is in such a state, first, the supply of power to the print unit 21 resumes and the increasing of the temperature of the fixing unit is started at the point of reception of the job request. Then, the image forming job is executed when the warming up of the fixing unit is completed. Thus, a certain amount of time is required from the reception of the job request until the start of the image forming job, and the user who initiated the image forming job is made to wait for a long time.

In contrast, when making the modification described above, where power continues to be supplied to the print unit 21 for the predetermined time (i.e. the operation mode is extended for the predetermined time), the charging time of the secondary battery 30 can be extended by charging performed over the predetermined time, and also, a new job request can be received during the predetermined time while the image forming device is still in the operation mode. Thus, the user would no longer need to wait for the completion of warm up, etc., and convenience for the user is increased.

(4) In the above embodiment, an explanation is given of an example using the AC-DC power supply 12, which converts AC from the commercial power supply 40 to DC, as the power source that supplies necessary voltage to the power supply control unit 13, the device body 20, etc. However, the present invention is not limited in this way. For example, provided that a high DC voltage is supplied from an external power supply, a DC-DC convertor may be used as the power source.

Also, in the above embodiment, the voltage boost circuit 82, which functions as the voltage booster, is implemented by using a driver IC. However, the present invention is not limited in this way. Provided that the voltage booster has a function of receiving the output voltage from the power source and boosting the received voltage to a voltage equal to or greater than the voltage required to fully charge the secondary battery 30, the voltage booster is not limited to being implemented by using a driver IC and may be realized by using any kind of circuit configuration.

(5) In the above embodiment, an explanation is given of an example configuration in which the I/F unit 22 functions as the reception unit that receives job requests. However, the present invention is not limited in this way. For example, the operator input unit 53 may function as the reception unit.

Specifically, the operator input unit 53 may function as the reception unit by being provided with a print key for receiving an instruction of print execution from the user. In such a case, the operator input unit 53 receives a job request when the print key is operated by the user. Further, when making this modification, the power required to receive an input operation of the print key is supplied to the operator input unit 53 by switching between the external power and the power of the secondary battery 30.

Also, for example a modification may be made such that a human-detecting sensor that detects a user approaching the device body 20 as a user who is about to issue an instruction for execution of an image forming job from the operator input unit 53, etc., may be used as the reception unit. One or more of the configurations described above may be used as the reception unit.

(6) In the above embodiment, switching between the first control and the second control is performed based on a detected voltage of the secondary battery 30. However, the present invention is not limited in this way. Provided that the information indicates the amount of energy of the secondary battery 30, such information as the current amount during charging (current×time), the charging time of the secondary battery 30, or the actual amount of energy of the secondary battery 30 may be used instead of the detected voltage of the secondary battery 30. The present invention may be configured to include a detection unit that detects, during charging of the secondary battery 30, the current amount, the charging time, or the actual amount of energy of the secondary battery 30, and switching of the charging method may be performed based on the value detected by the detection unit.

(7) In the above embodiment, the input and cutting-off of the external power is performed by the relay 11. However, the present invention is not limited in this way. A relay other than a latching relay or a mechanical switching element may be used for the input and cutting-off of the external power.

(8) In the above embodiment, an explanation is given of an example in which the image forming device pertaining to the present invention is applied to a multifunction device. However, the present invention is not limited in this way.

Provided that the image forming device may be switched between the sleep mode (the first mode), where voltage output from the power supply device 10 (the power source) is not used, power from the secondary battery 30 is supplied to the I/F unit 22 (reception unit), and the I/F unit 22 is able to receive a request for an image forming job, and the operation mode (the second mode), where the print unit 21 (the image forming unit) performs image forming upon reception of the request by using the power output from the power source, the image forming device may be a photocopier, printer, facsimile device, etc.

As described above, the sleep mode and the operation mode greatly differ from one another in terms of whether or not the output voltage from the power source is used as the drive source. Therefore, the sleep mode is a mode that stops the voltage output of the power source, and the operation mode is a mode that releases the stopping of the voltage output of the power source.

Also, in the above embodiment, explanation is given that the I/F unit 22 operates by using the external power and the power from the secondary battery 30 as a drive source. However, the present invention is not limited in this way. Any configuration is applicable provided that the reception unit operates and receives a job request by using the power from the secondary battery 30. For example, a configuration is possible where the I/F unit 22 is supplied the power from the secondary battery 30 without being supplied power from the commercial power supply 40, and the charging of the secondary battery 30 is performed during the operation mode.

Furthermore, in the above embodiment, explanation is given that the charge circuit 14 is provided with the constant current circuit 83. However, the present invention is not limited in this way. For example, a modification may be made such that the charge circuit 14 does not include the constant current circuit 83, provided that the non-inclusion of the constant current circuit 83 does not cause any problems in the charging of the secondary battery 30.

In addition, note that the above-described values for voltage, time, threshold values, amounts of energy, etc. are not limited to the values described above, and any values suitable for device configuration may be determined.

Also, present invention may be any combination of the above embodiment and modifications.

<Summary>

The above embodiment and modifications indicate one aspect for solving the technical problem explained in the Description of the Related Art, and a summary of the above embodiment and modifications is given below.

One aspect of the present invention is an image forming device comprising: a reception unit that receives a request for image forming; an image forming unit that performs image forming upon reception of the request by the reception unit and based on the request; a switching unit configured to switch a mode of the image forming device, the mode including a first mode in which the reception unit is not supplied an output voltage from a power source, is supplied power from a secondary battery, and is able to receive the request, and a second mode in which the image forming unit is supplied the output voltage from the power source and performs the image forming; a detection unit configured to detect a value of an amount of energy in the secondary battery; and a charging unit having a voltage booster and being configured to charge the secondary battery by performing a first control of supplying the output voltage from the power source to the secondary battery, and a second control of boosting the output voltage from the power source through the voltage booster and supplying the boosted voltage to the secondary battery, the charging unit, when the mode is the second mode, performing the first control when the value is equal to or less than a predetermined threshold value, and performing the second control when the value is greater than the predetermined threshold value.

In the image forming device pertaining to one aspect to the present invention, when the mode is not the second mode and the value is below a target value that is equal to or less than the threshold value, between a start time and a end time of a specific interval for supplemental charging, set within a predetermined unit period, the charging unit may perform the first control, and thereby perform supplemental charging of the secondary battery. In the image forming device pertaining to one aspect to the present invention, the unit period may include a first time period and a second time period consecutive to the first time period, in the second time period the receiving unit receiving the request at a lower frequency than in the first time period, and the specific interval may be set within the first time period, and may begin at a predetermined time Ta prior to a start time of the second time period and may end at the start time of the second time period.

In the image forming device pertaining to one aspect to the present invention, the unit period may be one day, and when the time Ta is included in a day that is not a non-working day and precedes a non-working day, each non-working day having been determined in advance, during the specific interval the charging unit may switch to performing the second control and thereby perform the supplementary charging after the value reaches the target value due to the first control being performed.

In the image forming device pertaining to one aspect to the present invention, in the non-working day the receiving unit may receive the request at a frequency equal to or lower than in the second time period.

In the image forming device pertaining to one aspect to the present invention, during the second time period, when the mode is the first mode and the value drops to a predetermined lower limit voltage, the charging unit may charge the secondary battery by performing the first control.

In the image forming device pertaining to one aspect to the present invention, during the specific interval, when the mode is the first mode and the value drops below the target value, the charging unit may perform the first control and thereby perform the supplemental charging.

In the image forming device pertaining to one aspect to the present invention, the mode may further include a third mode in which the reception unit is not supplied power from the secondary battery, is supplied the output voltage from the power source, and is able to receive the request, the switching unit may switch the mode between the second mode and the third mode during the first time period, and switch the mode between the first mode and the second mode during the second time period, and during the specific interval, when the mode is the third mode and the value drops below the target value, the charging unit may perform the first control and thereby perform the supplemental charging.

In the image forming device pertaining to one aspect to the present invention, the output voltage of the power source may be lower than a voltage required to fully charge the secondary battery, and the boosted voltage may be a voltage equal to or higher than the voltage required to fully charge the secondary battery.

In the image forming device pertaining to one aspect to the present invention, the charging unit may have a constant current circuit, and when the first control is performed, the output voltage of the power source may be supplied to the secondary battery via the constant current circuit, and when the second control is performed, the boosted voltage may be supplied to the secondary battery via the constant current circuit.

In the image forming device pertaining to one aspect to the present invention, the threshold value may be equal to the value of the amount of energy in the secondary battery when the secondary battery reaches the maximum possible voltage attainable by performing the first control.

In the image forming device pertaining to one aspect to the present invention, the charging unit may be a circuit and have a switch element that is connected in parallel to the voltage booster, and when the first control is performed, the switch element may conduct, and when the second control is performed, the switch element may be open.

In the image forming device pertaining to one aspect to the present invention, the value may be a value indicating either a voltage across the secondary battery, the amount of energy in the secondary battery, or a charging time of the secondary battery.

Another aspect of the present invention is a charging method of a secondary battery that is installed in an image forming device including a reception unit that receives a request for image forming, and an image forming unit that performs image forming upon reception of the request by the reception unit and based on the request, the charging method comprising: switching a mode of the image forming device, the mode including a first mode in which the reception unit is not supplied an output voltage from a power source, is supplied power from a secondary battery, and is able to receive the request, and a second mode in which the image forming unit is supplied the output voltage from the power source and performs the image forming; detecting a value of an amount of energy in the secondary battery; and charging the secondary battery by performing a first control of supplying the output voltage from the power source to the secondary battery, and a second control of boosting the output voltage from the power source through a voltage booster and supplying the boosted voltage to the secondary battery, and when the mode is the second mode, performing the first control when the value is equal to or less than a predetermined threshold value, and performing the second control when the value is greater than the predetermined threshold value.

As described above, by charging the secondary battery by switching between the first control and the second control, the charging can be performed without using the voltage booster until the threshold is reached. As such, power loss caused by the voltage booster is reduced compared with a configuration in which the voltage boosted by the voltage booster is used from the start of charging of the secondary battery until the secondary battery is fully charged. Thus, the present invention improves the charging efficiency of the secondary battery.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming device comprising:

a reception unit that receives a request for image forming;

an image forming unit that performs image forming upon reception of the request by the reception unit and based on the request;

a switching unit configured to switch a mode of the image forming device, the mode including a first mode in which the reception unit is not supplied an output voltage from a power source, is supplied power from a secondary battery, and is able to receive the request, and a second mode in which the image forming unit is supplied the output voltage from the power source and performs the image forming;

a detection unit configured to detect a value of an amount of energy in the secondary battery; and a charging unit having a voltage booster and being configured to charge the secondary battery by performing a first control of supplying the output voltage from the power source to the secondary battery, and a second control of boosting the output voltage from the power source through the voltage booster and supplying the boosted voltage to the secondary battery, the charging unit, when the mode is the second mode, performing the first control when the value is equal to or less than a predetermined threshold value, and performing the second control when the value is greater than the predetermined threshold value, wherein when the mode is not the second mode and the value is below a target value that is equal to or less than the threshold value, between a start time and an end time of a specific interval for supplemental charging, set within a predetermined unit period, the charging unit performs the first control, and thereby performs supplemental charging of the secondary battery.

2. The image forming device of claim 1, wherein the unit period includes a first time period and a second time period consecutive to the first time period, in the second time period the receiving unit receiving the request at a lower frequency than in the first time period, and the specific interval is set within the first time period, and begins at a predetermined time Ta prior to a start time of the second time period and ends at the start time of the second time period.

3. The image forming device of claim 2, wherein the unit period is one day, when the time Ta is included in a day that is not a non-working day and precedes a non-working day, each non-working day having been determined in advance, during the specific interval the charging unit switches to performing the second control and thereby performs the supplementary charging after the value reaches the target value due to the first control being performed.

4. The image forming device of claim 3, wherein in the non-working day the receiving unit receives the request at a frequency equal to or lower than in the second time period.

5. The image forming device of claim 2, wherein during the second time period, when the mode is the first mode and the value drops to a predetermined lower limit voltage, the charging unit charges the secondary battery by performing the first control.

6. The image forming device of claim 2, wherein the mode further includes a third mode in which the reception unit is not supplied power from the secondary battery, is supplied the output voltage from the power source, and is able to receive the request, the switching unit switches the mode between the second mode and the third mode during the first time period, and switches the mode between the first mode and the second mode during the second time period, and during the specific interval, when the mode is the third mode and the value drops below the target value, the charging unit performs the first control and thereby performs the supplemental charging.

7. The image forming device of claim 1, wherein during the specific interval, when the mode is the first mode and the value drops below the target value, the charging unit performs the first control and thereby performs the supplemental charging.

8. The image forming device of claim 1, wherein the output voltage of the power source is lower than a voltage required to fully charge the secondary battery, and the boosted voltage is a voltage equal to or higher than the voltage required to fully charge the secondary battery.

9. The image forming device of claim 1, wherein the charging unit has a constant current circuit, and when the first control is performed, the output voltage of the power source is supplied to the secondary battery via the constant current circuit, and when the second control is performed, the boosted voltage is supplied to the secondary battery via the constant current circuit.

10. The image forming device of claim 1, wherein the threshold value is equal to the value of the amount of energy in the secondary battery when the secondary battery reaches the maximum possible voltage attainable by performing the first control.

11. The image forming device of claim 1, wherein the charging unit is a circuit and has a switch element that is connected in parallel to the voltage booster, and when the first control is performed, the switch element conducts, and when the second control is performed, the switch element is open.

12. The image forming device of claim 1, wherein the value is a value indicating either a voltage across the secondary battery, the amount of energy in the secondary battery, or a charging time of the secondary battery.

13. A charging method of a secondary battery that is installed in an image forming device including a reception unit that receives a request for image forming and an image forming unit that performs image forming upon reception of the request by the reception unit and based on the request, the charging method comprising:

switching a mode of the image forming device, the mode including a first mode in which the reception unit is not supplied an output voltage from a power source, is supplied power from a secondary battery, and is able to receive the request, and a second mode in which the image forming unit is supplied the output voltage from the power source and performs the image forming;

detecting a value of an amount of energy in the secondary battery; and charging the secondary battery by performing a first control of supplying the output voltage from the power source to the secondary battery, and a second control of boosting the output voltage from the power source through a voltage booster and supplying the boosted voltage to the secondary battery, and when the mode is the second mode, performing the first control when the value is equal to or less than a predetermined threshold value, and performing the second control when the value is greater than the predetermined threshold value, wherein when the mode is not the second mode and the value is below a target value that is equal to or less than the threshold value, between a start time and an end time of a specific interval for supplemental charging, set within a predetermined unit period, the first control is performed to thereby perform supplemental charging of the secondary battery.

14. The image forming device of claim 13, wherein the unit period includes a first time period and a second time period consecutive to the first time period, in the second time period the receiving unit receiving the request at a lower frequency than in the first time period, and the specific interval is set within the first time period, and begins at a predetermined time Ta prior to a start time of the second time period and ends at the start time of the second time period.

15. The image forming device of claim 14, wherein the unit period is one day, when the time Ta is included in a day that is not a non-working day and precedes a non-working day, each non-working day having been determined in advance, during the specific interval the second control is performed to thereby perform the supplementary charging after the value reaches the target value due to the first control being performed.

16. The image forming device of claim 15, wherein in the non-working day the receiving unit receives the request at a frequency equal to or lower than in the second time period.

17. The image forming device of claim 14, wherein during the second time period, when the mode is the first mode and the value drops to a predetermined lower limit voltage, the secondary battery is charged by performing the first control.

18. The image forming device of claim 14, wherein the mode further includes a third mode in which the reception unit is not supplied power from the secondary battery, is supplied the output voltage from the power source, and is able to receive the request, the mode is switched between the second mode and the third mode during the first time period, and is switched between the first mode and the second mode during the second time period, and during the specific interval, when the mode is the third mode and the value drops below the target value, the first control is performed to thereby perform the supplemental charging.

19. The image forming device of claim 13, wherein during the specific interval, when the mode is the first mode and the value drops below the target value, the first control is performed to thereby perform the supplemental charging.

* * * * *